US007603223B2

(12) United States Patent
Moriya

(10) Patent No.: US 7,603,223 B2
(45) Date of Patent: Oct. 13, 2009

(54) APPARATUS FOR ADJUSTING VALVE TIMING WHEN STARTING INTERNAL COMBUSTION ENGINE

(75) Inventor: Yoshihito Moriya, Nagoya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 335 days.

(21) Appl. No.: 11/794,531

(22) PCT Filed: Jan. 23, 2006

(86) PCT No.: PCT/JP2006/301374

§ 371 (c)(1),
(2), (4) Date: Jul. 2, 2007

(87) PCT Pub. No.: WO2006/080470

PCT Pub. Date: Aug. 3, 2006

(65) Prior Publication Data

US 2009/0048758 A1 Feb. 19, 2009

(30) Foreign Application Priority Data

Jan. 25, 2005 (JP) ..... 2005-017150

(51) Int. Cl.
*F02D 45/00* (2006.01)
*F02D 13/02* (2006.01)

(52) U.S. Cl. ..... 701/103; 123/90.15

(58) Field of Classification Search ..... 701/103, 701/102, 113; 123/90.15–90.17
See application file for complete search history.

(56) References Cited

U.S. PATENT DOCUMENTS 6,354,255 B1 3/2002 Methley et al.
6,843,214 B1 1/2005 Herrin
2003/0131814 A1 7/2003 Tsujimura et al.
2003/0172888 A1 9/2003 Miura
2004/0084000 A1 5/2004 Takenaka et al.
2004/0168659 A1 9/2004 Shindou et al.
2004/0231624 A1 11/2004 Shindou et al.
2006/0272608 A1 * 12/2006 Hara et al. ..... 123/182.1
2007/0144473 A1 * 6/2007 Nakamura et al. ..... 123/90.16

FOREIGN PATENT DOCUMENTS

EP 1 111 206 A2 6/2001
EP 1 344 897 A2 9/2003
JP A 10-141097 5/1998
JP 11-153045 A * 6/1999
JP A 2003-041994 2/2003
JP A 2004-150397 5/2004

* cited by examiner

*Primary Examiner*—Hieu T Vo
(74) *Attorney, Agent, or Firm*—Oliff & Berridge, PLC

(57) ABSTRACT

An internal combustion engine includes a plurality of variable valve timing mechanism (VVTs), each corresponding to one of a pair of banks. When an abnormality is detected in a VVT corresponding to one of the banks, the valve closing timing of the intake valves during starting of the engine in the bank corresponding to the normally functioning VVT is adjusted to valve timing that increases the power generated by combustion compared to the engine power generated during normal starting of the engine. Specifically, the valve closing timing of the intake valves during starting of the engine in the bank corresponding to the normally functioning VVT is brought closer to the bottom dead center of the intake stroke of the engine. As a result, deterioration of the starting performance of the engine due to the abnormality of the VVT is compensated for.

9 Claims, 21 Drawing Sheets

APPARATUS FOR ADJUSTING VALVE TIMING WHEN STARTING INTERNAL COMBUSTION ENGINE

FIELD OF THE INVENTION

The present invention relates to an apparatus that adjusts the valve timing of an internal combustion engine when starting the engine, the engine having variable valve timing mechanisms each for adjusting the intake valve timing or the exhaust valve timing.

BACKGROUND OF THE INVENTION

A technique has been proposed which provides a V-type internal combustion engine with a variable valve timing mechanism on each of the banks, and adjusts the valve timing according to the difference of combustion conditions between the banks (for example, refer to Japanese Laid-Open Patent Publication No. 10-141097). Further, Japanese Laid-Open Patent Publication No. 2004-150397 discloses a technique for adjusting valve timing using an electric actuator.

Japanese Laid-Open Patent Publication No. 10-141097 discloses a valve timing control apparatus. The publication does not directly disclose valve timing control performed when the engine is being started. However, in normal conditions, regardless whether the engine is started cold or warm, the engine is started at generalized valve timing.

For example, the intake valve closing timing is set to a specific valve timing for starting the engine in a closing valve timing range for normal engine operation by using the variable valve timing apparatus having an electric actuator disclosed in Japanese Laid-Open Patent Publication No. 2004-150397. Such a specific intake valve closing timing is set in consideration of the balance between the rotational resistance of the engine and the driving force of a starter, such that the engine rotates smoothly and the start of the engine caused by starting combustion is completed at a relatively early stage.

However, in the case where the cylinders are divided into groups in two banks, and the valve timing is adjustable for each cylinder group as in Japanese Laid-Open Patent Publication No. 10-141097, the valve timing adjustment at one of the banks can be abnormal. In the case of Japanese Laid-Open Patent Publication No. 2004-150397, the electric actuator can malfunction.

In this case, since the malfunctioning intake camshaft does not receive the driving force for adjusting the valve timing generated, for example, by the electric actuator, the intake valve timing is moved to the most retarded state by the rotational resistance generated in the intake camshaft during cranking. Since the intake valve timing of the normally functioning bank can be adjusted, for example, by the electric actuator, the intake valve timing is set to the above mentioned specific valve closing timing.

However, considering the entire internal combustion engine, the intake valve closing timing of the malfunctioning bank is retarded compared to that of the normal engine starting, and considerable part of air that has been drawn into the combustion chambers is discharged to the intake ports from the intake valves. That is, sufficient amount of air cannot be used in the combustion at the beginning of the engine starting. Therefore, although one of the banks is functioning normally, the starting performance of the entire internal combustion engine deteriorates. Particularly, for starting an engine cold, a greater amount of intake air is needed than when starting the engine after warming. The starting performance thus can noticeably deteriorate when starting an engine cold.

Such deterioration of starting performance due to abnormal adjustment of valve timing in a bank can also occurs in a case where an engine is equipped with an apparatus for adjusting exhaust valve timing. That is, a variable exhaust valve timing mechanism incorporates a spring that advances valve opening timing. Therefore, if a variable exhaust valve timing mechanism is malfunctioning and the driving force of, for example, an electric actuator cannot be used when starting the engine, the exhaust valve timing is held excessively advanced by the urging force of the spring. The engine is thus started with the excessively advanced exhaust valve opening timing. Thus, during combustion at the beginning of the starting of the engine, the pressure in the combustion chambers can fail to be transmitted to the crankshaft through the pistons. Therefore, although one of the banks is functioning normally, the starting performance of the entire internal combustion engine deteriorates. The starting performance can noticeably deteriorate when starting the engine cold.

Such abnormality of valve timing adjustment also can occur in an internal combustion engine in which the intake valve timing and the exhaust valve timing of a single bank are adjustable. That is, deterioration of the starting performance due to an abnormality in one of the valve timing adjustments can degrade the starting performance of an entire internal combustion engine even if the other valve timing adjustment is being performed normally, and such deterioration is particularly noticeable when starting the engine cold.

SUMMARY OF THE INVENTION

Accordingly, it is an objective of the present invention to prevent the starting performance of an engine from deteriorating when part of a plurality of variable valve timing mechanisms are malfunctioning.

To achieve the foregoing and other objectives and in accordance with the purpose of the present invention, an apparatus for adjusting valve timing when starting an internal combustion engine is provided. The engine has a plurality of variable valve timing mechanisms. Each valve timing mechanism is capable of adjusting the valve timing of an intake valve or an exhaust valve. The apparatus includes an abnormality detection section and a compensation section. The abnormality detection section detects an abnormality in the valve timing mechanisms. When the abnormality detection section detects an abnormality of at least one of the valve timing mechanisms, the compensation section adjusts the valve timing during starting of the engine realized by at least one of the valve timing mechanisms that is functioning normally to valve timing that increases the power generated by combustion compared to the power generated during normal starting of the engine.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
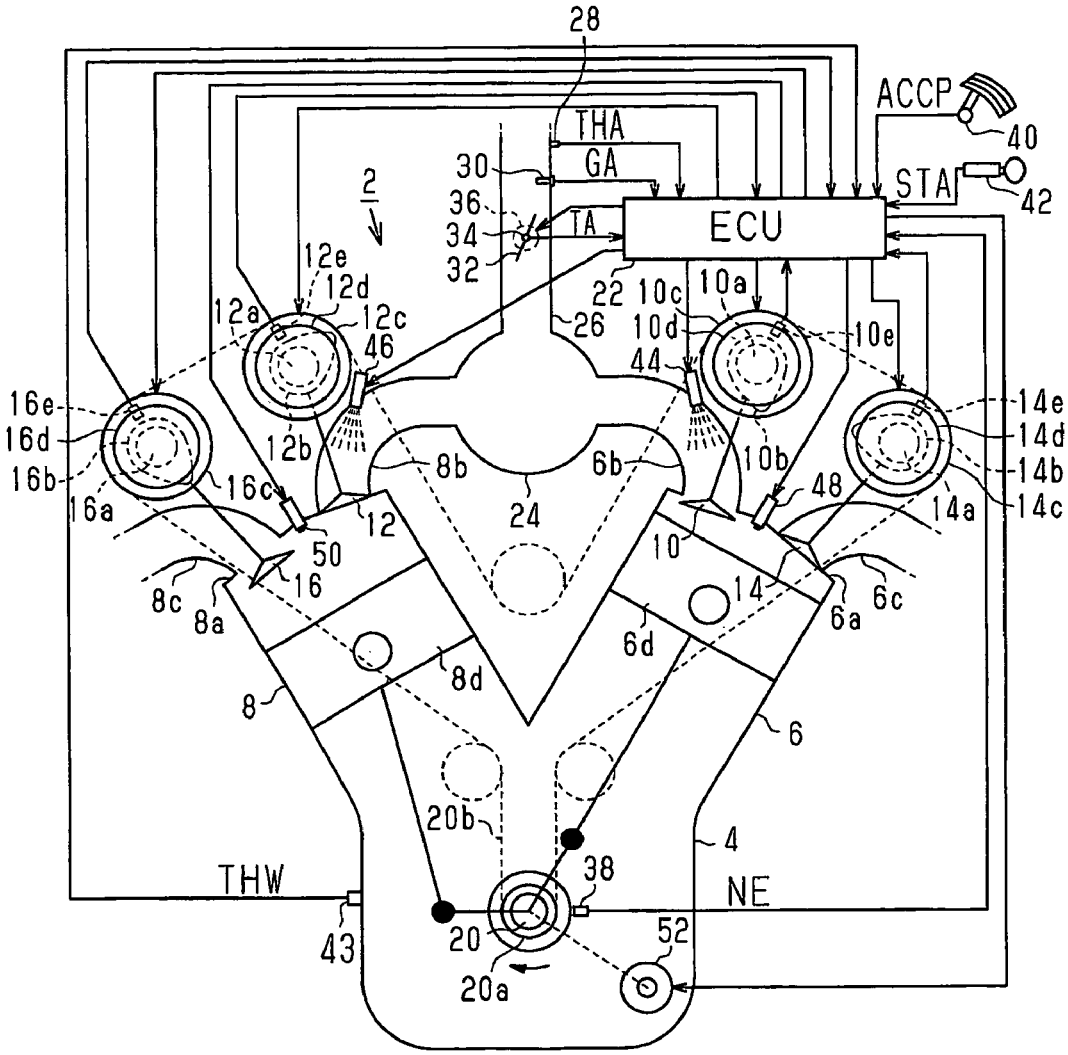
FIG. 1 is a diagrammatic view showing an engine and its control system according to a first embodiment.

FIG. 1 is a diagrammatic view illustrating a vehicle engine 2 and its control system to which the present invention is applied. The engine 2 is a V-type six-cylinder gasoline engine.

The engine 2 has a cylinder block 4 with two banks 6, 8. Cylinder heads 6*a*, 8*a* are attached to the banks 6, 8, respectively. Each of the banks 6, 8 has three cylinders. Intake ports 6*b*, 8*b* and exhaust ports 6*c*, 8*c* are formed in the banks 6, 8 to correspond to each of the cylinders. The intake ports 6*b*, 8*b* are opened and closed by intake valves 10, 12, and the exhaust ports 6*c*, 8*c* are opened and closed by exhaust valves 14, 16. In the following, only a pair of the cylinders in the banks 6, 8, and the associated components will be discussed in reference to FIG. 1, as representing all the cylinders and the surrounding components.

Intake camshafts 10*a*, 12*a* are provided on the cylinder heads 6*a*, 8*a*, respectively. The intake valves 10, 12 are actuated by intake cams 10*b*, 12*b*, which rotate together with the intake camshafts 10*a*, 12*a*. Exhaust camshafts 14*a*, 16*a* are provided on the cylinder heads 6*a*, 8*a*, respectively. The exhaust valves 14, 16 are actuated by exhaust cams 14*b*, 16*b*, which rotate together with the exhaust camshafts 14*a*, 16*a*.

The intake camshafts 10*a*, 12*a* and the exhaust camshafts 14*a*, 16*a* are rotated at half a rotation speed of a crankshaft 20, or at half the engine speed NE, in synchronization with rotation of a crank sprocket 20*a*, which is rotated by the crankshaft 20. The rotational force of the crank sprocket 20*a* is transmitted to cam sprockets 10*c*, 12*c*, 14*c*, 16*c* by a timing chain 20*b* shown by a broken line. The cam sprockets 10*c*, 12*c*, 14*c*, 16*c* are not directly coupled to the camshafts 10*a*, 12*a*, 14*a*, 16*a*, but transmit the rotational force to the camshafts 10*a* to 16*a* through variable valve timing mechanisms (hereinafter, referred to as VVTs) 10*d*, 12*d*, 14*d*, 16*d*.

The VVTs 10*d* to 16*d*, each incorporate an electric actuator. Depending on the rotation direction of the associated electric actuator, each of the VVTs 10*d* to 16*d* advances or retards the valve timing of the corresponding one of the valves 10 to 16 with respect to the corresponding cam sprocket 10*c* to 16*c*. The electric actuators are controlled by electronic control unit (ECU) 22 in accordance with the operating condition.

Figure 2:
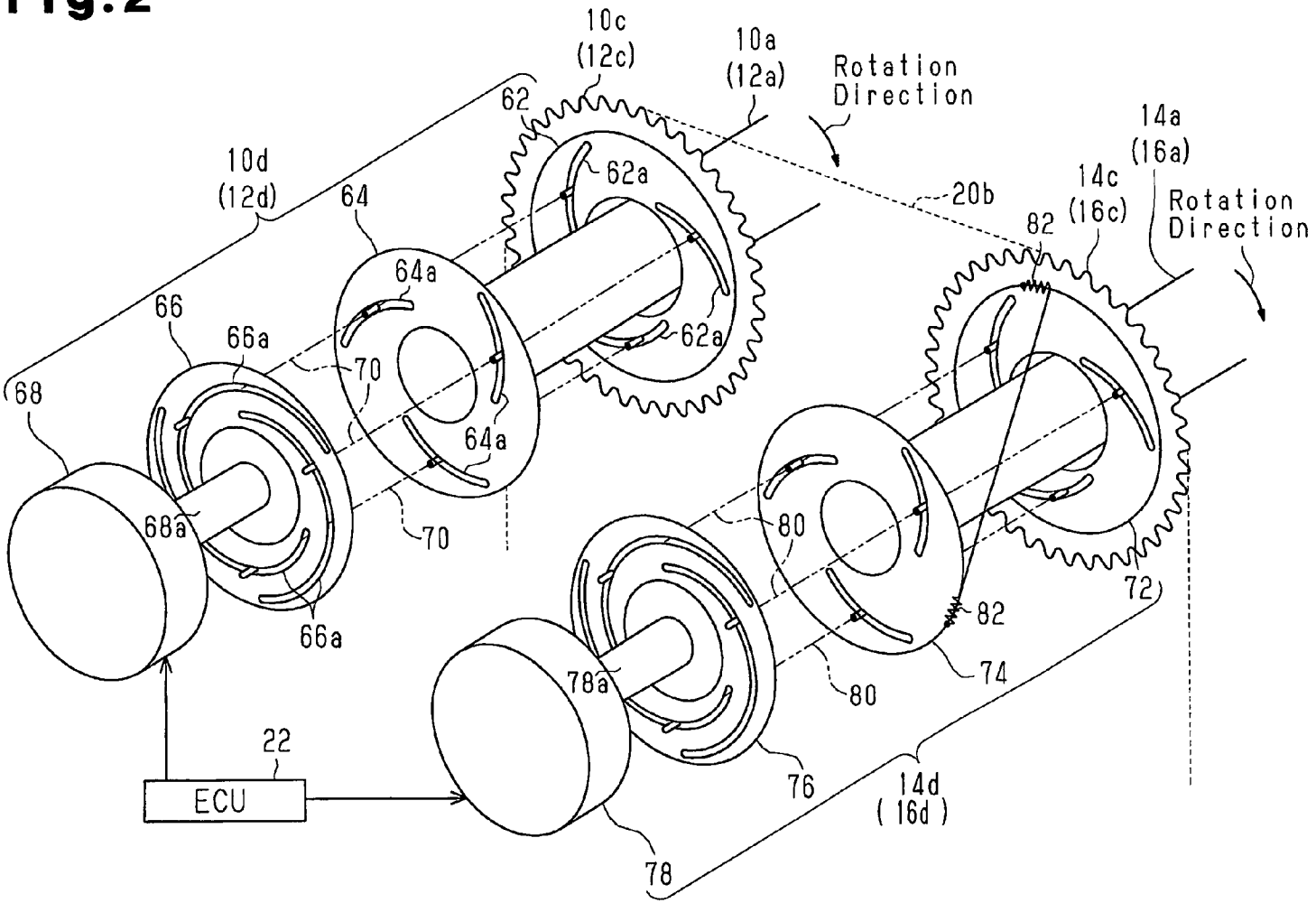
FIG. 2 is a perspective view illustrating the structure of a VVT according to the first embodiment.

The VVTs 10*d* to 16*d*, for example, may be the devices disclosed in Japanese Laid-Open Patent Publication No. 2004-150397. The exploded perspective view of FIG. 2 illustrates the VVTs 10*d*, 14*d* in the left bank 6. The right bank 8 has basically the same construction as the left bank 6 described below except that the arrangement of the VVT 12*d* of the intake valve 12 and the VVT 16*d* of the exhaust valve 16 is reversed.

As shown in FIG. 2, the VVT 10*d* of the intake valve 10 includes a first engagement plate 62, a second engagement plate 64, a control plate 66, an electric motor 68 functioning as an electric actuator, and three control pins 70. The first engagement plate 62 is fixed to the cam sprocket 10*c* and rotates integrally with the cam sprocket 10*c*. The second engagement plate 64 is fixed to the camshaft 10*a* and rotates integrally with the camshaft 10*a*. The electric motor 68 is fixed to the cylinder head 6*a* and applies rotational torque to the control plate 66.

The first engagement plate 62 and the second engagement plate 64 each have three helical slits 62*a*, 64*a*. The helical slits 62*a* of the first engagement plate 62 gradually separate from the axis with respect to the rotation direction of the camshaft 10*a*, while the helical slits 64*a* of the second engagement plate 64 gradually approach the axis with respect to the rotation direction. The control plate 66 has three helical slits 66*a*, which, gradually separate from the axis with respect to the rotation direction of the camshaft 10*a*. The helical slits 66*a* are less inclined than the helical slits 62*a* of the first engagement plate 62.

The control pins 70 extend along the axial direction through the helical slits 62*a*, 64*a*, 66*a*. The electric motor 68 is controlled by the ECU 22 and adjusts rotational torque applied to the control plate 66 through an output shaft 68*a*. When no drive current is supplied to the electric motor 68, if the cam sprocket 10*c* rotates, rotational resistance generated in the camshaft 10*a* retards the phase of the second engagement plate 64 relative to the first engagement plate 62, and the three control pins 70 are moved toward the axis. Consequently, the valve timing of the intake valve 10 is maximally retarded. A spring may be provided between the first engagement plate 62 and the second engagement plate 64 to urge the second engagement plate 64 in a phase retarding direction relative to the first engagement plate 62 when no drive current is supplied to the electric motor 68, so that the valve timing of the intake valves 10 is reliably shifted to the most retarded valve timing.

To obtain constant valve timing of the intake valve 10, the electric motor 68 applies to the control plate 66 phase maintaining rotational torque in a phase retarding direction, or in a direction opposite to the rotation direction of the camshaft 10*a*. This prevents the three control pins 70 from moving either toward or away from the axis, and the valve timing of the intake valve 10 is fixed.

When the ECU 22 controls the electric motor 68 to weaken the phase maintaining rotational torque, or to apply to the control plate 66 rotational torque in the same direction as the rotation direction of the camshaft 10*a* (phase advancing direction), the control plate 66 is rotated in the phase advancing direction. Accordingly, the control pins 70 move toward the axis while being guided by the helical slits 66*a*, and the second engagement plate 64 moves relative to the first engagement plate 62 so that the rotational phase of the second engagement plate 64 is retarded relative to that of the first engagement plate 62. The phase of the camshaft 10*a* is thus retarded relative to the cam sprocket 10*c*. As a result, the valve timing of the intake valve 10 determined by the intake cam 10*b* is retarded.

Contrastingly, if rotational torque of a certain magnitude or greater is applied to the control plate 66 in the phase retarding direction, the control pins 70 move radially outward while being guided by the helical slits 66*a* as the control plate 66 rotates in the phase retarding direction. Accordingly, the second engagement plate 64 moves relative to the first engagement plate 62 so that the rotational phase of the second engagement plate 64 is advanced relative to that of the first engagement plate 62. The phase of the camshaft 10*a* is thus advanced relative to the cam sprocket 10*c*. As a result, the valve timing of the intake valve 10 determined by the intake cam 10*b* is advanced.

The configuration and functions described above are common to the VVT 12*d* of the intake valve 12 in the right bank 8. The ECU 22 is thus capable of advancing and retarding the valve timing of the intake valves 10, 12.

The VVT 14*d* of the exhaust valve 14 includes a first engagement plate 72, a second engagement plate 74, a control plate 76, an electric motor 78, three control pins 80, and a spring 82. The first engagement plate 72, the second engagement plate 74, the control plate 76, the electric motor 78, and the control pins 80 have the same structures as those of the corresponding components in the VVTs 10*d*, 12*d* of the intake valves 10, 12.

The VVT 14*d* of the exhaust valve 14 however has the spring 82 extending between the first engagement plate 72 and the second engagement plate 74. The spring 82 always urges the second engagement plate 74 in the phase advancing direction with respect to the first engagement plate 72. Therefore, when no drive current is supplied to the electric motor 78, the phase of the second engagement plate 74 is advanced relative to the first engagement plate 72 by the force of the spring 82, and the valve timing of the exhaust valve 14 is consequently most advanced. To obtain constant valve timing of the exhaust valve 14, the electric motor 78 applies phase maintaining rotational torque of a certain magnitude to the control plate 76 in the phase advancing direction. The configuration and functions described above are common to the VVT 16*d* of the exhaust valve 16 in the right bank 8. The ECU 22 is thus capable of advancing and retarding the valve timing of the exhaust valves 14, 16 by controlling the corresponding electric motors 78.

The intake ports 6*b*, 8*b*, in which the valve timings of the intake valves 10, 12 are adjusted as described above, converge at a surge tank 24 as shown in FIG. 1, and the surge tank 24 receives air that has passed through an air cleaner (not shown) through an intake passage 26. An intake temperature sensor 28 for detecting an intake air temperature THA and an intake air amount sensor 30 for detecting an intake air amount GA are provided in the intake passage 26. Also, a throttle valve 32 for adjusting the intake air amount to the cylinders is provided in the intake passage 26. The throttle valve 32 is driven by an electric motor 36 and has a throttle opening sensor 34 that detects a throttle opening degree TA.

The exhaust ports 6*c*, 6*c*, in which the valve timings of the exhaust valves 14, 16 are adjusted in the above described manner, are connected to an exhaust pipe, in which an exhaust purification catalyst and a muffler are provided, with an exhaust manifold.

The ECU 22 receives signals from various types of sensors and switches as well as from the intake temperature sensor 28, the intake air amount sensor 30, and the throttle opening sensor 34. That is, the ECU 22 receives signals from a rotation speed sensor 38 provided for the crankshaft 20, cam angle sensors 10*e*, 12*e*, 14*e*, 16*e* for detecting rotational phases of the camshafts 10*a* to 16*a*, an accelerator pedal position sensor 40, a starter switch 42, and a coolant temperature sensor 43 for detecting an engine coolant temperature THW.

Based on these signals and control quantities obtained through various types of computations, the ECU 22 controls the various types of devices. That is, the ECU 22 controls the intake air amount with the throttle valve 32, the fuel injection amount and the injection timing from fuel injection valves 44, 46, the ignition timing with ignition plugs 48, 50, the valve timing with the VVTs 10*d* to 16*d*, and starting of the engine 2 with a starter motor 52.

Figure 3:
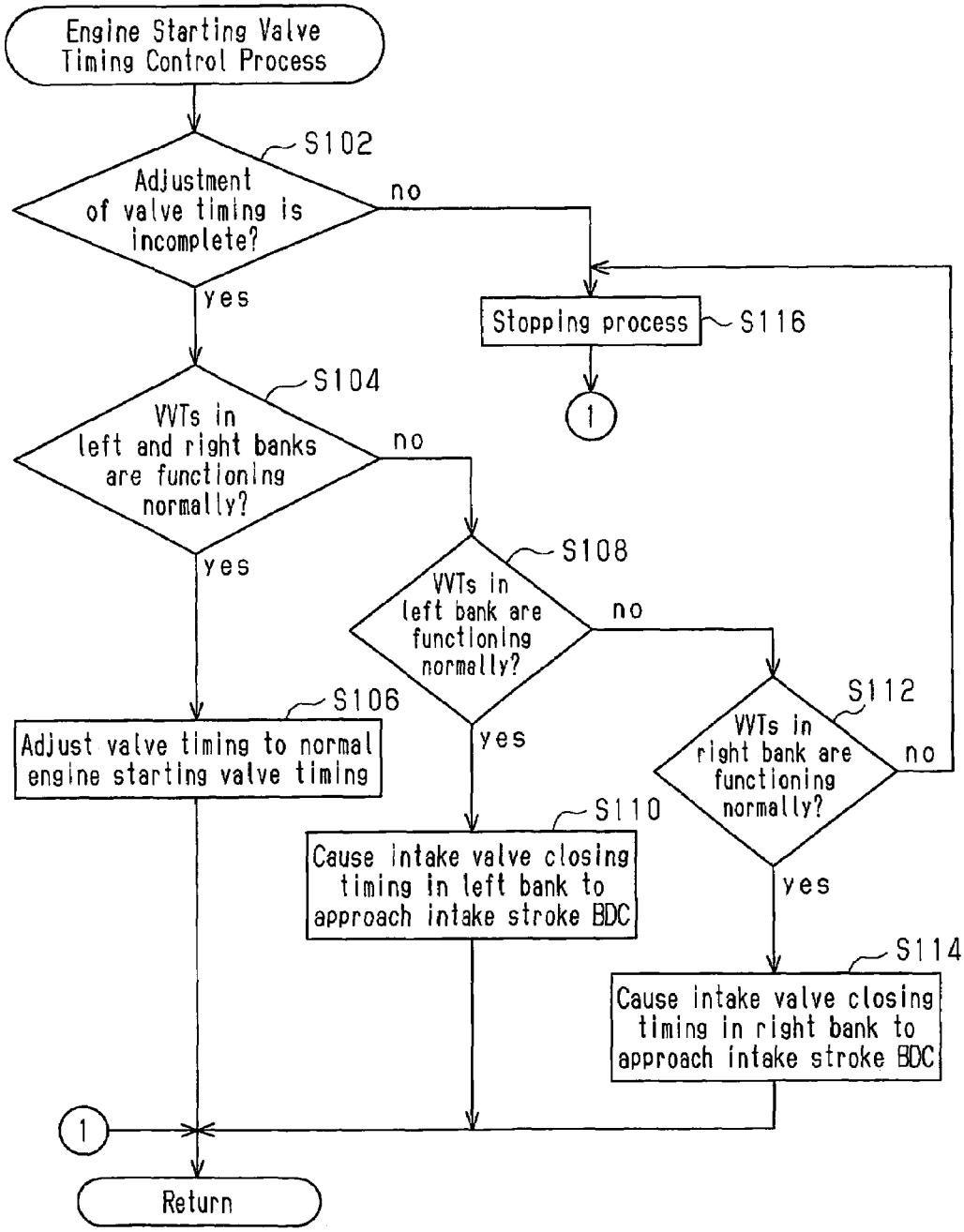
FIG. 3 is a flowchart showing an engine starting valve timing control process executed by an ECU according to the first embodiment.

Among the processes executed by the ECU 22, an engine starting valve timing control process is shown in the flowchart of FIG. 3. In the engine starting valve timing control process, the ECU 22 adjusts the valve timing of each of the valves 10 to 16 during starting of the engine 2. This process is started when the starter switch 42 is turned on, and is repeatedly executed at short time intervals until normal adjustment of the VVTs 10*d* to 16*d* is completed.

When this process is started, the ECU 22 determines whether adjustment of the valve timing of the VVTs 10*d* to 16*d* required to be completed during starting is incomplete (S102). Since the adjustment is incomplete at the beginning (yes at S102), whether the VVTs 10*d* to 16*d* in the left bank 6 and the right bank 8 are all functioning normally is determined (S104). At the beginning, abnormality is not detected. Thus, the VVTs 10*d* to 16*d* are determined to be functioning normally (yes at S104).

Then, the VVTs 10*d* to 16*d* are controlled to adjust the valve timings of the valves 10 to 16 to normal engine starting valve timing (S106). That is, the valve timing of the intake valves 10, 12 is set as shown by solid line in FIG. 4A based on the detection values of the cam angle sensors 10*e*, 12*e* and the rotation speed sensor 38. Further, the valve timing of the exhaust valves 14, 16 is set as shown by solid line in FIG. 4B based on the detection values of the cam angle sensors 14*e*, 16*e* and the rotation speed sensor 38 (S106). That is, the intake valve timing is set such that the closing timing of each intake valve is retarded relative to the bottom dead center (BDC) in the intake stroke of the associated cylinder by a phase retarding value θis. The phase retarding value θis determined through experiments and in consideration of the relationship between the power of the starter motor 52 and the compression pressure in the combustion chambers such that the engine 2 is smoothly started by rotating the crankshaft 20 by the starter motor 52, and that the engine rotation is stabilized by combustion immediately after the engine 2 is started.

The exhaust valve timing is set such that the opening timing of each exhaust valve is advanced relative to the BDC in the expansion stroke of the associated cylinder by a phase advancing value θes. The phase advancing value θes is determined through experiments in view of the balance between the rotational force of the engine 2 obtained by combustion at the beginning of starting of the engine 2 and a favorable valve timing that is determined in consideration of valve overlap after starting the engine 2.

These valve timings for normal engine starting are determined in advance as generalized engine starting valve timings and stored in ROM of the ECU 22.

Figure 4A:
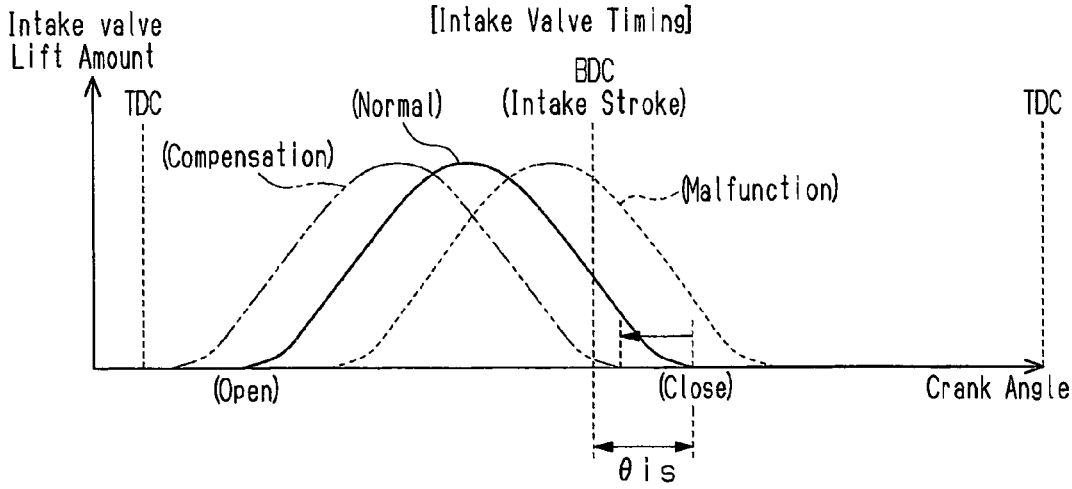
FIG. 4A is a graph showing the valve timing of an intake valve.
Figure 4B:
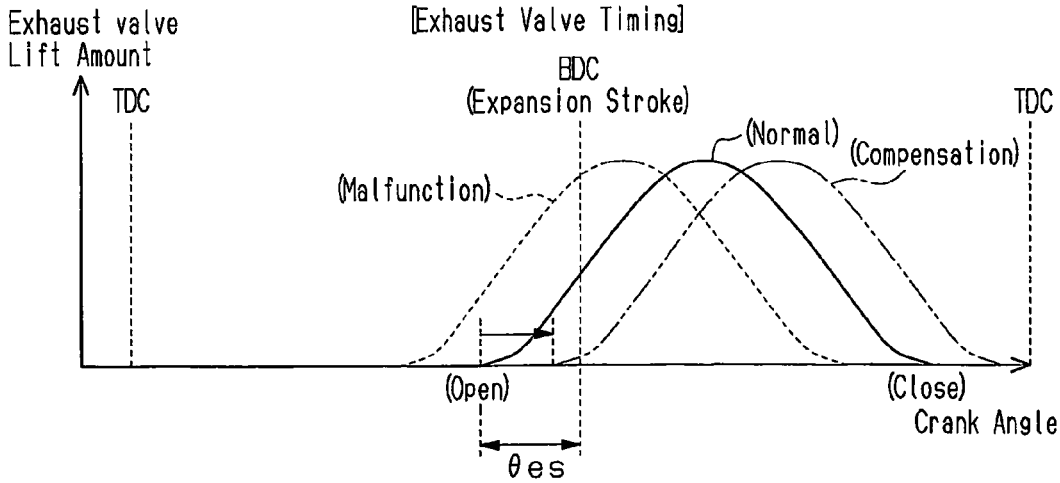
FIG. 4B is a graph showing the valve timing of an exhaust valve.

The electric motors 68, 78 provided for the VVTs 10*d* to 16*d* are actuated such that the actual valve timings match with the normal engine starting valve timings shown by solid line in FIGS. 4A and 4B. The process is then temporarily ended.

When the control of the four electric motors 68, 78 is started, the ECU 22 can detect abnormality of the electric motors 68, 78 based on the values of drive voltages and drive currents applied to the electric motors 68, 78.

If the valve timing adjustment is still determined to be incomplete in the subsequent cycle (yes at S102), whether all the VVTs 10*d* to 16*d* in the left and right banks 6, 8 are functioning normally is determined (S104). If the drive voltages and the drive currents are not different from those of the normal condition in any of the electric motors 68, 78, the VVTs 10*d* to 16*d* in the left and right banks 6, 8 are determined to be functioning normally (yes at S104), and the above described normal engine starting VVT control (S106) is continued.

When the valve timing of solid line in FIG. 4 is achieved, the adjustment is determined to be complete (no at S102). In this case, a process for stopping periodic execution of the process is executed (S116). In this manner, the engine starting valve timing control process is ended, and control after cranking is started.

During the periodic execution of the engine starting valve timing control process, if the drive voltage or the drive current to any of the electric motors 68, 78 are different from those of the normal condition, it is determined that not all the VVTs 10*d* to 16*d* in the left and right banks 6, 8 are functioning normally (no at S104). Accordingly, whether the VVTs 10*d*, 14*d* in the left bank 6 are functioning normally is determined (S108). That is, whether both of or one of the VVTs 12*d*, 16*d* in the right bank 8 are malfunctioning is determined.

If the VVTs 10*d*, 14*d* in the left bank 6 are functioning normally (yes at S108), the electric motor 68 of the VVT 10*d* for the intake valve 10 in the left bank 6 is actuated to change the valve timing to valve timing for compensation shown by alternate long and short dash line in FIG. 4A. That is, a process is executed in which the valve closing timing of the intake valve 10 is changed from the valve timing retarded relative to the intake stroke BDC by the phase retarding value θis, and is caused to approach the intake stroke BDC (S110). Specifically a control for advancing the valve closing timing of the intake valve 10 is executed.

For example, when the intake valve VVT 12*d* in the right bank 8 is malfunctioning, rotational torque of the electric motor 68 is not transmitted to the control plate 66 shown in FIG. 2. During cranking of the engine 2, rotational resistance of the camshaft 12*a* causes the valve timing of the intake valve 12 to be the most retarded valve timing as shown by broken line (representing malfunction) of FIG. 4A. When the valve closing timing of the intake valve 12 is the most retarded valve timing, a large portion of intake air that has been drawn into the combustion chamber through the intake valve 12 flows back to the intake port 8*b*. This significantly reduces the intake air amount to be used in combustion, and thus hinders starting of the engine 2.

When the starting performance deteriorates due to malfunction of the VVT 12*d* in the right bank 8, the starting performance can be improved more by causing the valve closing timing of the intake valve 10 to approach the intake stroke BDC than by causing the valve timing of the normally functioning left bank 6 to be the intake valve timing for the normal condition. That is, since the intake air amount is reduced in the malfunctioning right bank 8 as described above, the rotation resistance due to compression pressure is also reduced. Therefore, even if the valve closing timing of the intake valve 10 of the normally functioning left bank 6 is caused to approach the intake stroke BDC to increase the intake air amount so that the compression resistance is increased, the increase in the compression resistance is cancelled in the entire engine 2. Thus, the intake air amount of the left bank 6 is increased by the amount corresponding to the amount by which the valve closing timing of the normally functioning intake valve 10 is advanced toward the intake stroke BDC. This increases the engine power generated by combustion, and prevents the starting performance from deteriorating due to the malfunction of the VVT 12*d* in the right bank 8.

For example, when the exhaust valve VVT 16*d* in the right bank 8 is malfunctioning, rotational torque of the electric motor 78 is not transmitted to the control plate 76 shown in FIG. 2. During cranking of the engine 2, the urging force of the spring 82 causes the valve timing of the exhaust valve 16 to be the most advanced valve timing as shown by broken line (representing malfunction) of FIG. 4B. When the valve opening timing of the exhaust valve 16 is most advanced, a piston 8*d* cannot receive sufficient combustion pressure in the combustion chamber immediately after combustion is started. This hinders a stable starting of the engine 2.

When the starting performance deteriorates due to malfunction of the VVT 16*d* in the right bank 8, the power produced by combustion at the normally functioning left bank 6 can be increased by causing the valve closing timing of the intake valve 10 to approach the intake stroke BDC. Accordingly, the rotation stability of the entire engine 2 immediately after combustion is started is improved. As a result, the starting performance is prevented from deteriorating.

When the valve timing adjustment is completed after repeating the process (S110) for causing the valve closing timing of the normally functioning intake valve 10 to approach the intake stroke BDC from the state retarded by the phase retarding value θis (no at S102), the ending process is executed (S116) to end the engine starting valve timing control process (FIG. 3).

Next, a case will be discussed in which one of or both of the VVTs 10*d*, 14*d* in the left bank 6 are malfunctioning (no at S108), and the VVTs 12*d*, 16*d* in the right bank 8 function normally (yes at S112). Contrary to the case discussed above, the electric motor 68 of the VVT 12*d* for the intake valve 12 in the right bank 8 is actuated to change the valve timing to the compensation valve timing shown by alternate long and short dash line in FIG. 4A. That is, a process is executed in which the valve closing timing of the intake valve 12 is changed from the valve timing retarded relative to the intake stroke BDC by the phase retarding value θis, and is caused to approach the intake stroke BDC (S114). Specifically a control for advancing the valve closing timing of the intake valve 10 is executed. In the manner described above, the starting performance is prevented from deteriorating.

When the left and right banks 6, 8 are both malfunctioning (no at S112), the process is ended after the ending process (S116) is executed.

When any one of the VVTs 10*d* to 16*d* in the left and right banks 6, 8 is malfunctioning (no at S104), the ECU 22 outputs a warning message, for example, by causing a warning lamp provided in the dashboard to light up.

Figure 5:
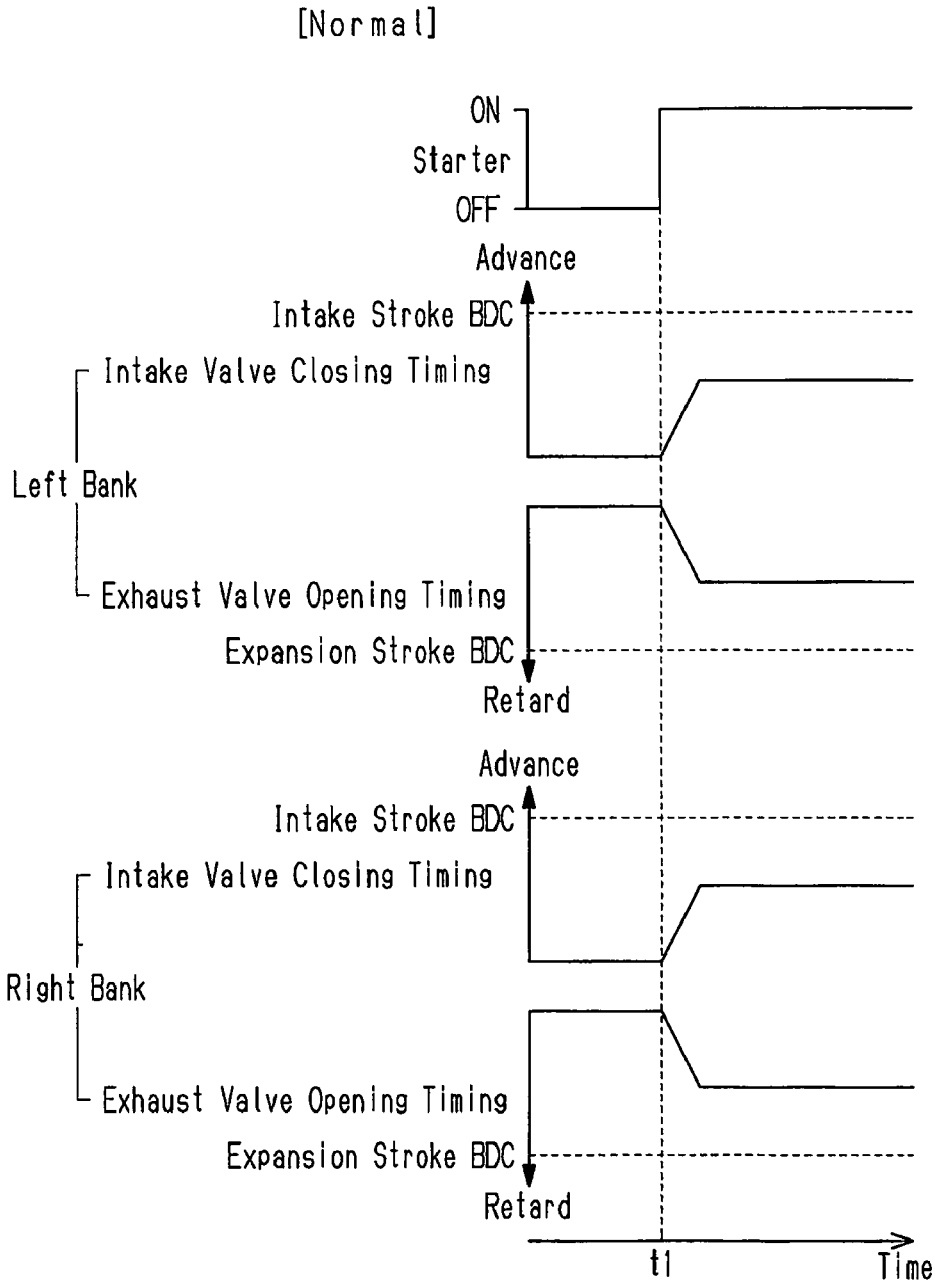
FIG. 5 is a timing chart showing an example of a control in normal condition according to the first embodiment.
Figure 6:
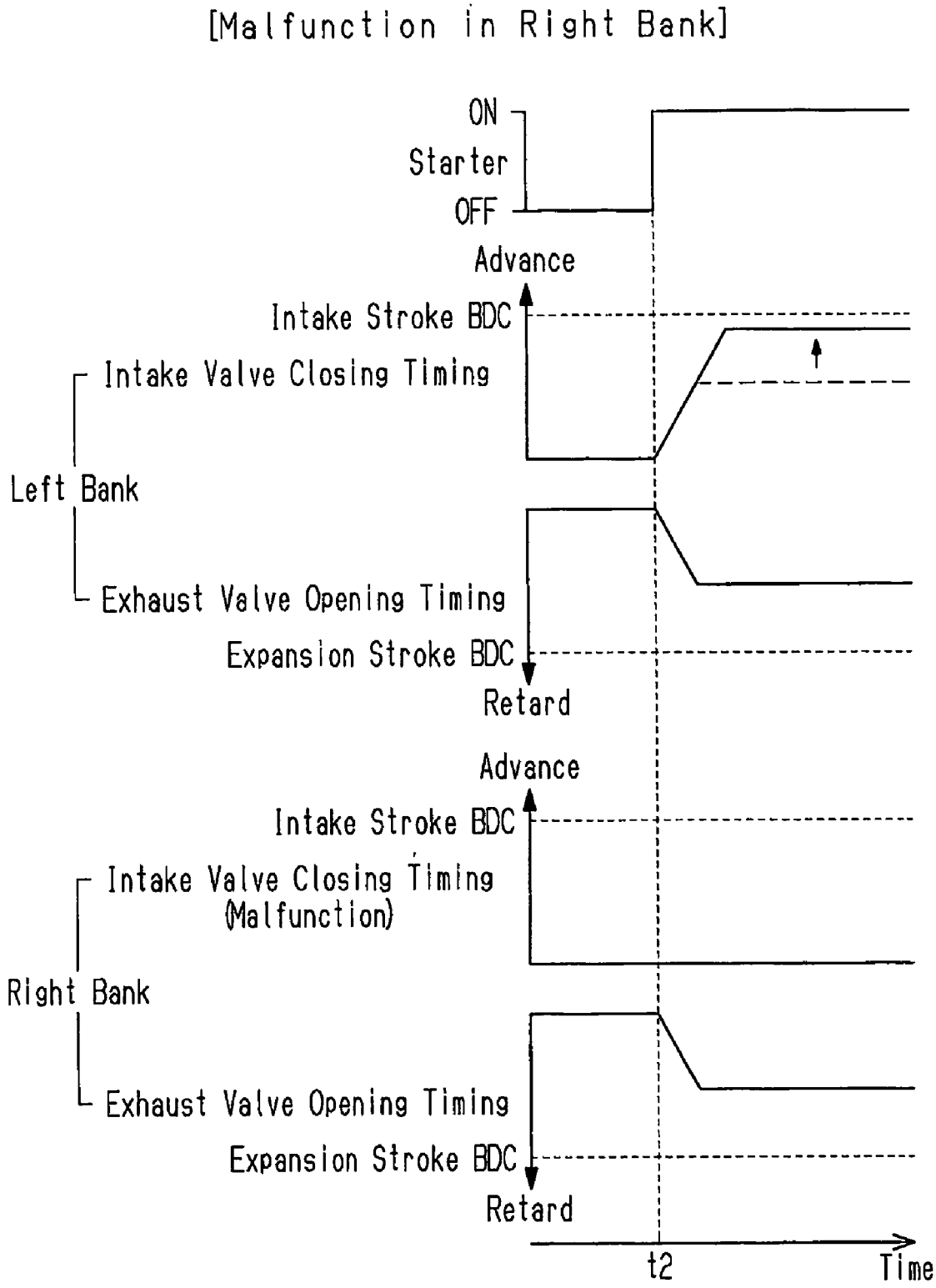
FIG. 6 is a timing chart showing an example of a control in abnormal condition according to the first embodiment.
Figure 7:
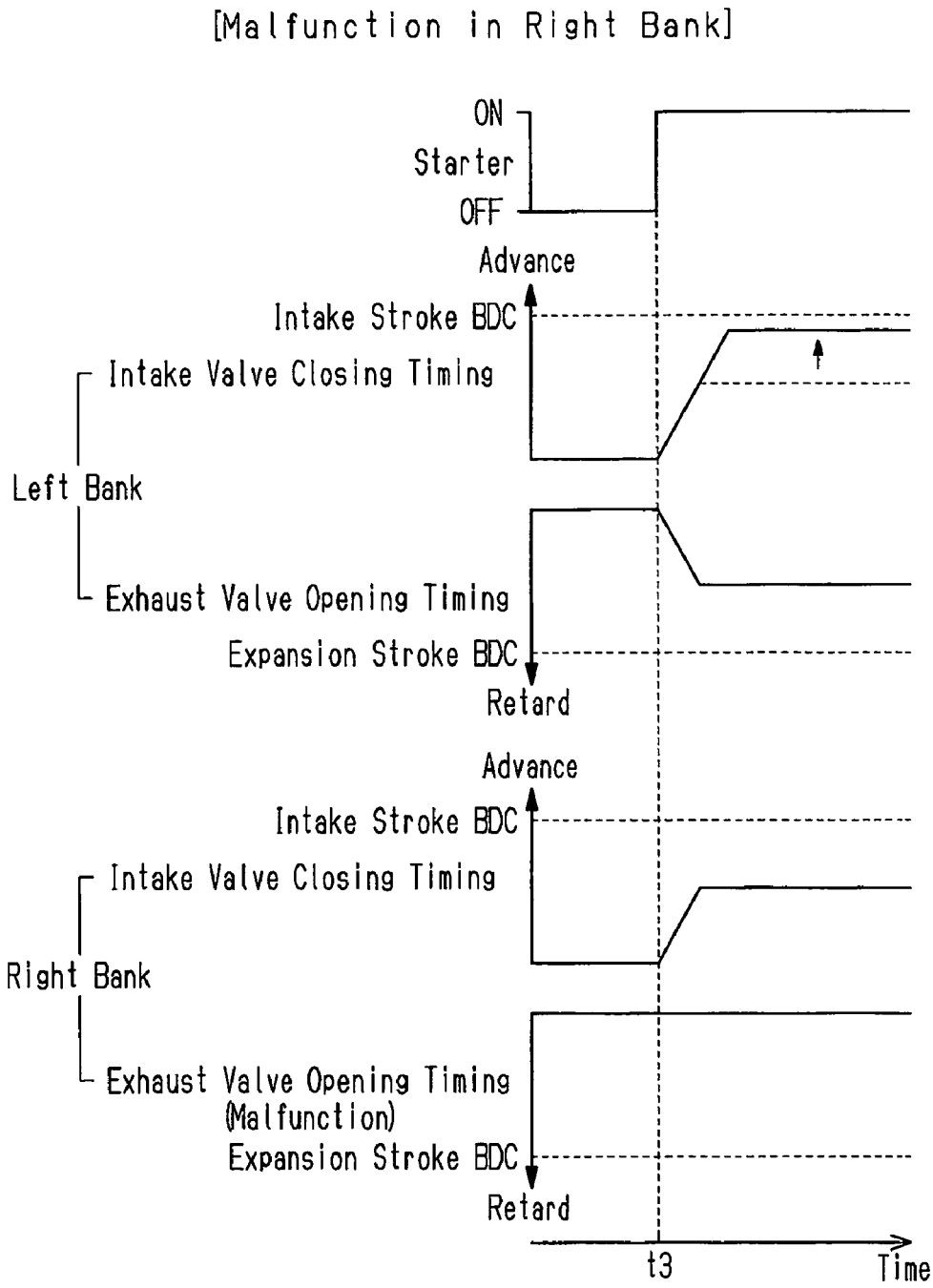
FIG. 7 is a timing chart showing another example of a control in abnormal condition according to the first embodiment.

Examples of the control executed according to the above described process will now be described with reference to FIGS. 5 to 7. FIG. 5 shows a timing chart in the normal condition, FIG. 6 shows a timing chart of a case where the intake valve VVT in the right bank 8 is malfunctioning, FIG. 7 shows a timing chart of a case where the exhaust valve VVT in the right bank 8 is malfunctioning. In FIG. 5, when the starter switch 42 is turned on (starter ON) at time t1, all the valve timings are shifted to the normal engine starting valve timings. In FIGS. 6 and 7, the intake valve closing timing of the normally functioning left bank 6 is caused to approach the intake stroke BDC immediately after the starter switch 42 is turned on (t2, t3) to prevent the starting performance from deteriorating.

In the above described configuration, the ECU 22 corresponds to an abnormality detection section and a compensation section. An abnormality determination process for the VVTs 10*d* to 16*d* executed based on the drive voltages and the drive currents applied to the electric motors 68, 78 corresponds to a process executed by the abnormality detection section, and steps S108 to S114 of the engine starting valve timing control process (FIG. 3) correspond to a process executed by the compensation section.

The first embodiment has the following advantages.

(1) When any of the VVTs 10*d* to 16*d* in either one in the left and right banks 6, 8 is malfunctioning during starting of the engine 2, the intake valve closing timing of the normally functioning bank is changed to valve timing that increases the power generated by combustion compared to the power generated during normal starting of the engine. That is, the intake valve closing timing of the normally functioning bank is controlled to approach the intake stroke BDC S110, S114). Accordingly, as described above, deterioration of the starting performance of the engine 2 caused by the malfunctioning one of the banks 6, 8 is compensated to some extent. In this manner, even if any of the VVTs 10*d* to 16*d* belonging to one of the two banks 6, 8 is malfunctioning, the starting performance does not deteriorate due to the malfunction.

(2) The VVTs 10*d* to 16*d* are driven by the electric actuators (in this embodiment, the electric motors) 68, 78. Since the VVTs 10*d* to 16*d* can be driven by the maximum power of the motors 68, 78 when starting the engine 2, the adjustable ranges of the valve timings are wide.

With such wide adjustable ranges, if the electric motors 68, 78 stop operating due to an abnormality, the valve closing timings of the intake valves 10, 12 are retarded by a great amount, and the valve opening timings the exhaust valves 14, 16 are advanced by a great amount. This is highly likely to cause the starting performance to deteriorate.

However, since the engine starting valve timing control process (FIG. 3) is executed in the above described manner, deterioration of the starting performance caused by a malfunctioning VVT is compensated to some extent. Therefore, deterioration of the starting performance due to such an abnormality is effectively prevented.

Figure 8:
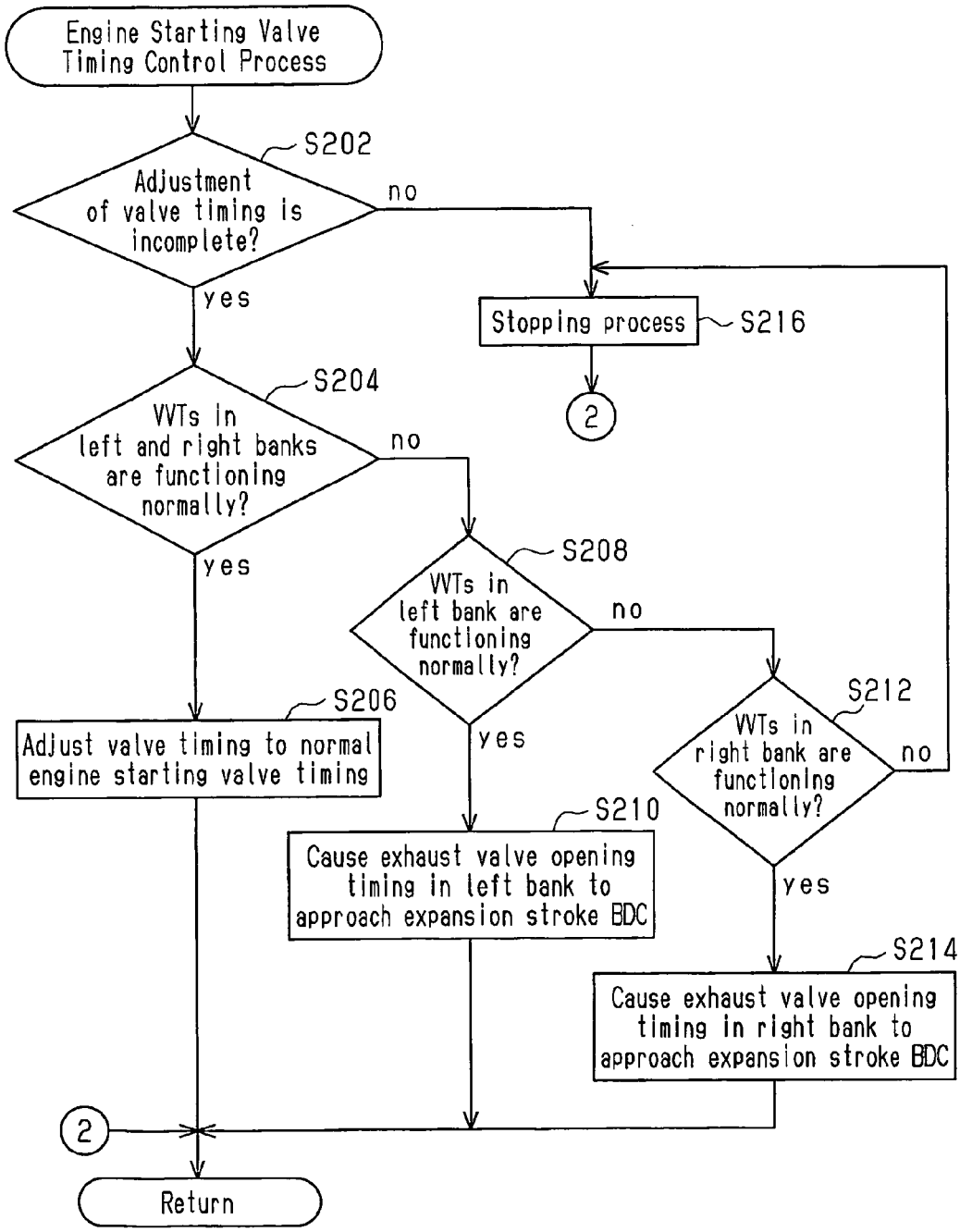
FIG. 8 is a flowchart showing an engine starting valve timing control process according to a second embodiment.

The second embodiment is different from the first embodiment in that an engine starting valve timing control process shown in FIG. 8 is executed instead of that shown in FIG. 3. The other components are the same as those in the first embodiment, and are thus described with reference to FIGS. 1 and 2. Further, in the engine starting valve timing control process of FIG. 8, steps S202 to S208, S212, and S216 are the same as steps S102 to S108, S112, and S116 in FIG. 3.

The differences are the following two processes (S210, S214). That is, when at least one of the VVTs 12*d*, 16*d* in the right bank 8 is malfunctioning, and the VVTs 10*d*, 14*d* in the left bank 6 are both functioning normally (yes at S208), the exhaust valve VVT 14*d* in the left bank 6 is actuated to cause the valve opening timing of the exhaust valve 14 to approach the expansion stroke BDC (S210). When at least one of the VVTs 10*d*, 14*d* in the left bank 6 is malfunctioning, and the VVTs 12*d*, 16*d* in the right bank 8 are both functioning normally (yes at S212), the exhaust valve VVT 16*d* in the right bank 8 is actuated to cause the valve opening timing of the exhaust valve 16 to approach the expansion stroke BDC (S214).

To cause the valve opening timing of either of the exhaust valves 14, 16 to approach the expansion stroke BDC, the electric motor 78 of the corresponding one of the exhaust valves 14, 16 is actuated so that the valve timing is changed as illustrated in FIG. 4B. That is, a process is executed in which the exhaust valve opening timing is changed from the valve timing advanced relative to the expansion stroke BDC by the phase advancing value θes, and is caused to approach the expansion stroke BDC (S210, S214). Specifically a control for retarding the valve opening timing is executed.

As described in the first embodiment, when any of the VVTs 10*d* to 16*d* in either one of the left and right banks 6, 8 is malfunctioning, the starting performance of the engine 2 deteriorates, accordingly. However, suppose that the VVTs in the normally functioning bank, for example, the VVTs 10*d*, 14*d* in the left bank 6 are functioning normally, the VVT 14*d* for the exhaust valve 14 in the left bank 6 is used for executing the control for causing the valve opening timing of the exhaust valve 14 to approach the expansion stroke BDC from the valve timing advanced relative to the expansion stroke BDC by the phase advancing value θes. This permits a piston 6*d* in the left bank 6 to receive combustion pressure in the combustion chamber for an extended period immediately after the combustion is started. Thus, the left bank 6 applies a greater rotational force to the crankshaft 20 compared to a normal condition. The starting performance of the entire engine 2 is prevented from deteriorating.

If the VVTs 12*d*, 16*d* in the right bank 8 are functioning normally, the VVT 16*d* for the exhaust valve 16 in the right bank 8 is used for executing the control for causing the valve opening timing of the exhaust valve 16 to approach the expansion stroke BDC from the valve timing advanced relative to the expansion stroke BDC by the phase advancing value θes. The starting performance of the entire engine 2 is prevented from deteriorating as in the previous case.

Figure 9:
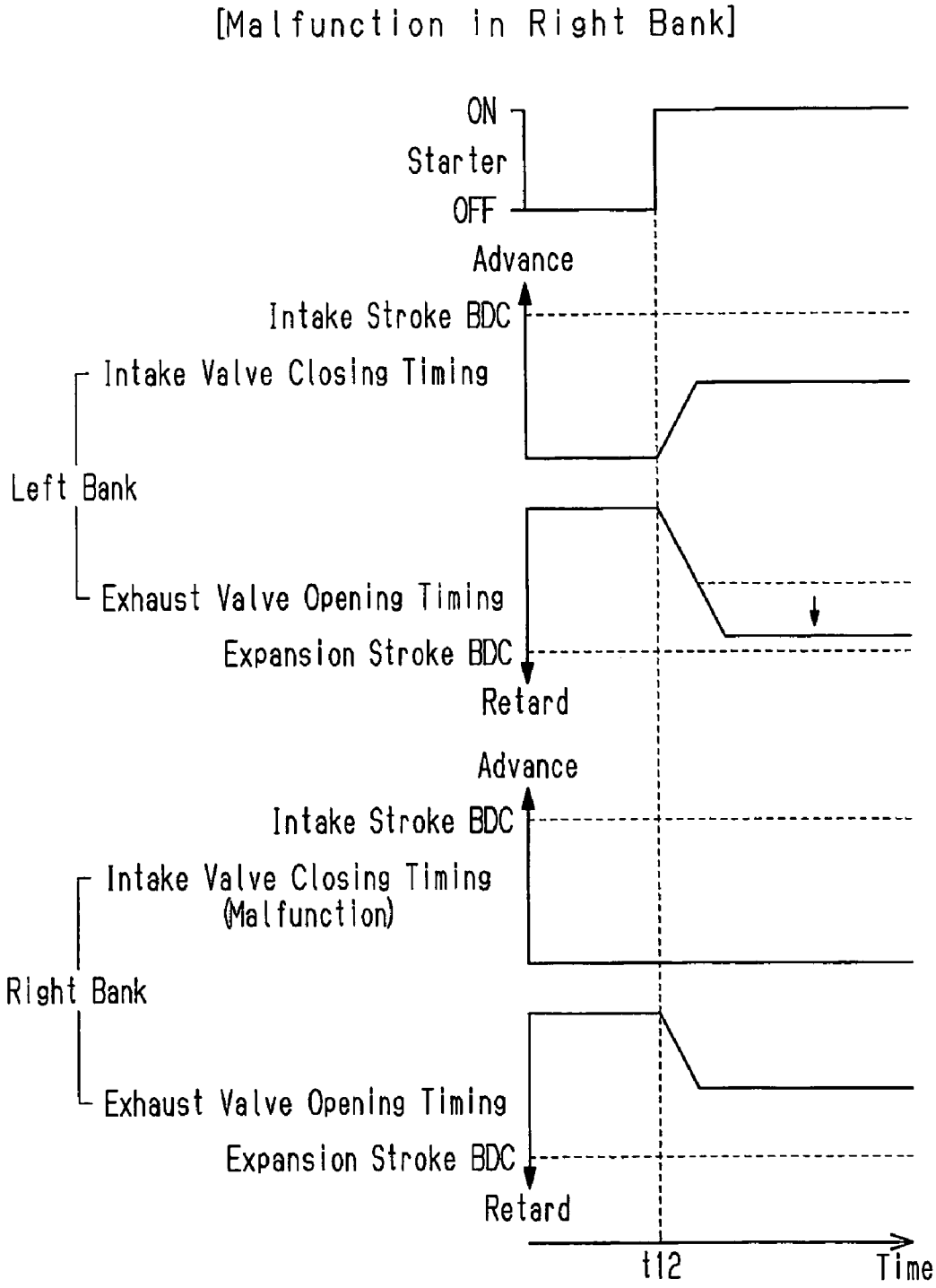
FIG. 9 is a timing chart showing an example of a control in abnormal condition according to the second embodiment.
Figure 10:
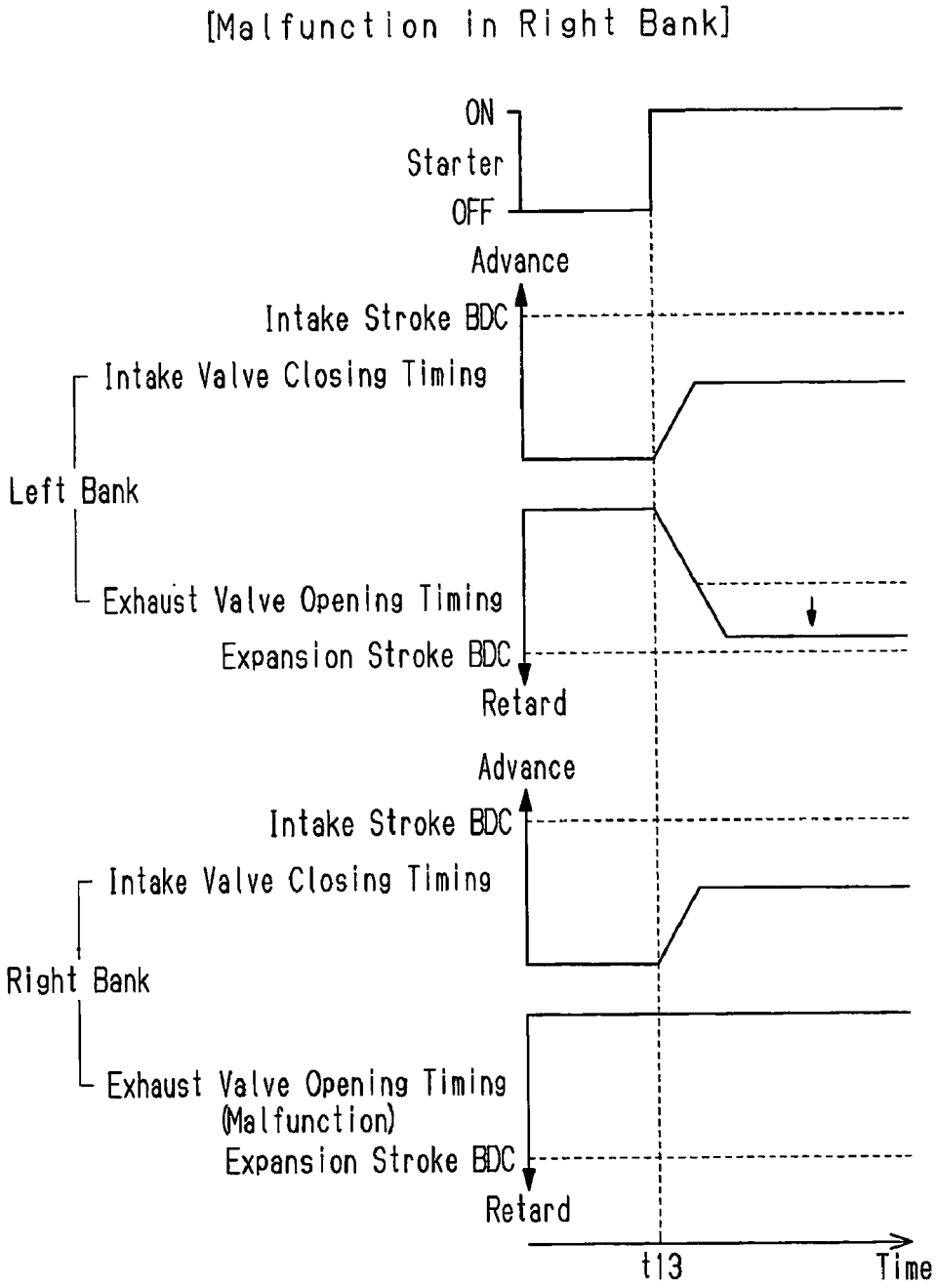
FIG. 10 is a timing chart showing another example of a control in abnormal condition according to the second embodiment.

Examples of the control executed according to the above described process will now be described with reference to FIGS. 9 and 10. FIG. 9 shows a timing chart of a case where the intake valve VVT in the right bank 8 is malfunctioning, FIG. 10 shows a timing chart of a case where the exhaust valve VVT in the right bank 8 is malfunctioning. The timing chart in the normal condition is the same as that according to the first embodiment shown in FIG. 5. In FIGS. 9 and 10, the exhaust valve opening timing of the normally functioning left bank 6 is caused to approach the expansion stroke BDC immediately after the starter switch 42 is turned on (t12, t13) to prevent the starting performance from deteriorating.

Steps S208 to S214 of the engine starting valve timing control process (FIG. 8) correspond to a process executed by the compensation section.

The second embodiment has the following advantages.

(1) When any of the VVTs 10*d* to 16*d* in either one of the left and right banks 6, 8 is malfunctioning, the exhaust valve opening timing of the normally functioning bank is changed to valve timing that increases the power generated by combustion compared to the power generated during normal starting of the engine. That is, the exhaust valve opening timing of the normally functioning bank is controlled to approach the expansion stroke BDC (S210, S214). Accordingly, as described above, deterioration of the starting performance of the engine 2 caused by the malfunctioning bank is cancelled to some extent. In this manner, even if any of the VVTs 10*d* to 16*d* belonging to one of the two banks 6, 8 is malfunctioning, the starting performance does not deteriorate due to the malfunction.

(2) The same advantage as the advantage (2) of the first embodiment is provided.

Figure 11:
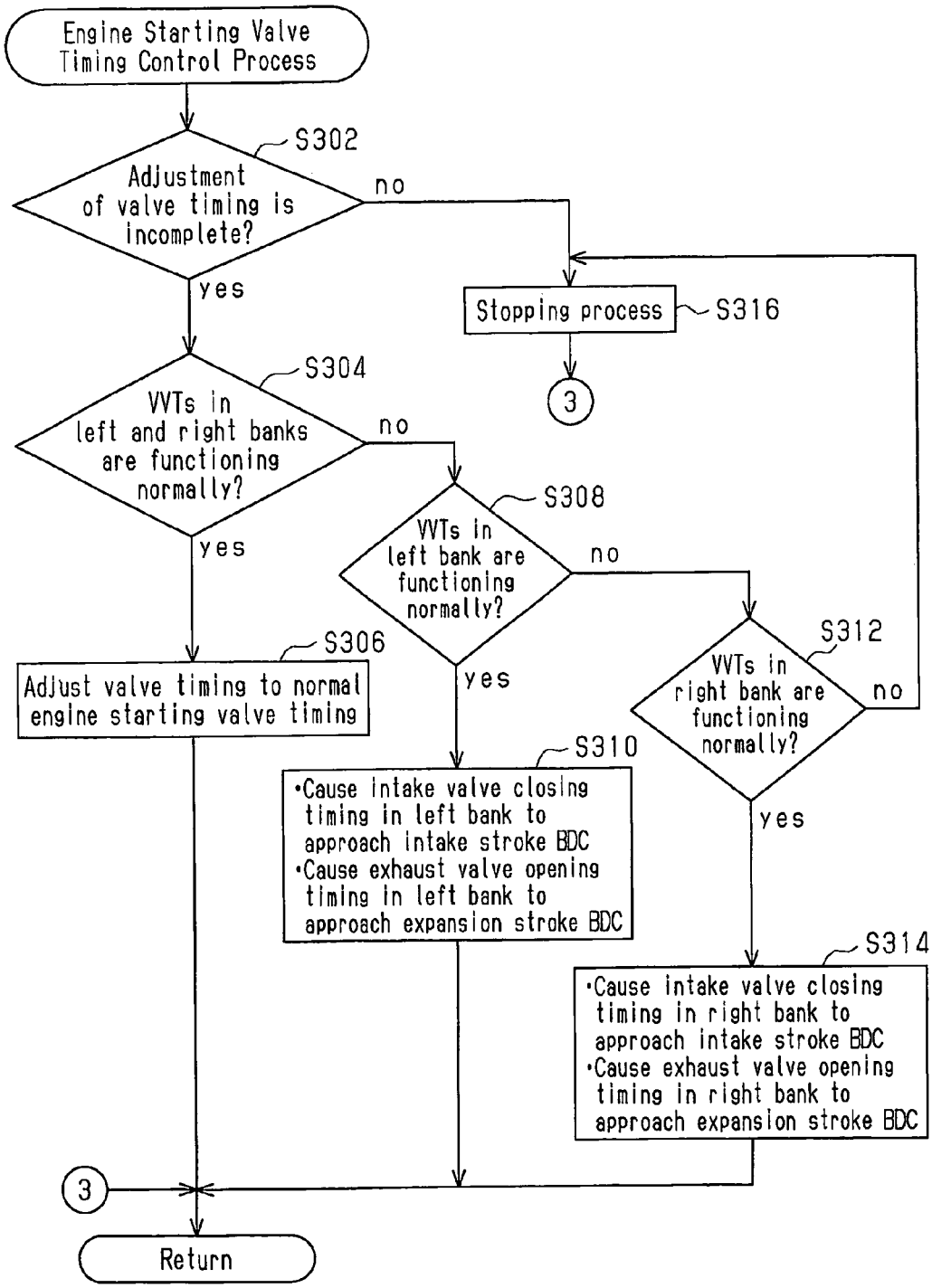
FIG. 11 is a flowchart showing an engine starting valve timing control process according to a third embodiment.

A third embodiment is different from the first embodiment in that an engine starting valve timing control process shown in FIG. 11 is executed instead of that shown in FIG. 3. The other components are the same as those in the first embodiment, and are thus described with reference to FIGS. 1 and 2.

In the engine starting valve timing control process of FIG. 11, steps S302 to S308, S312, and S316 are the same as steps S102 to S108, S112, and S116 in FIG. 3.

The differences are the following two processes (S310, S314). That is, when one or both of the VVTs 12*d*, 16*d* in the right bank 8 are malfunctioning, and the VVTs 10*d*, 14*d* in the left bank 6 are both functioning normally (yes at S308), the VVT 10*d* for the intake valve 10 in the left bank 6 is actuated at step S310 to cause the intake valve closing timing of the normal condition to approach the intake stroke BDC. Further, at step S310, the VVT 14*d* for the exhaust valve 14 in the left bank 6 is actuated to execute a process in which the exhaust valve opening timing of the normal condition is caused to approach the expansion stroke BDC.

When one or both of the VVTs 10*d*, 14*d* in the left bank 6 are malfunctioning, and the VVTs 12*d*, 16*d* in the right bank 8 are both functioning normally (yes at S312), the VVT 12*d* for the intake valve 12 in the right bank 8 is actuated at step S314 to cause the intake valve closing timing of the normal condition to approach the intake stroke BDC. Further, at step S314, the VVT 16*d* for the exhaust valve 16 in the right bank 8 is actuated to execute a process in which the exhaust valve opening timing of the normal condition is caused to approach the expansion stroke BDC.

As processes for preventing the starting performance from deteriorating, the process for causing the intake valve closing timing to approach the intake stroke BDC and the process for causing the exhaust valve opening timing to approach the expansion stroke BDC are executed.

Figure 12:
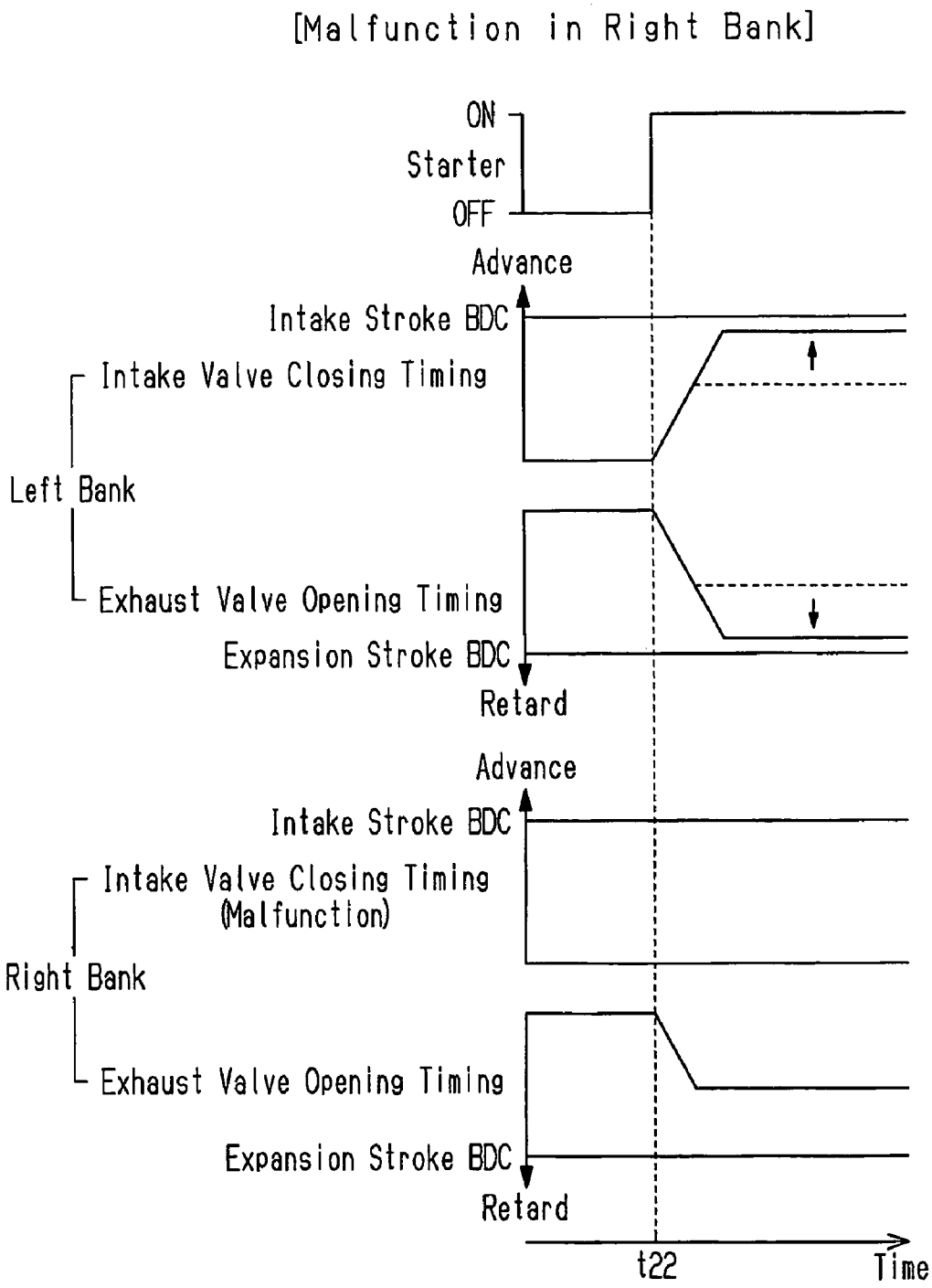
FIG. 12 is a timing chart showing an example of a control in abnormal condition according to the third embodiment.
Figure 13:
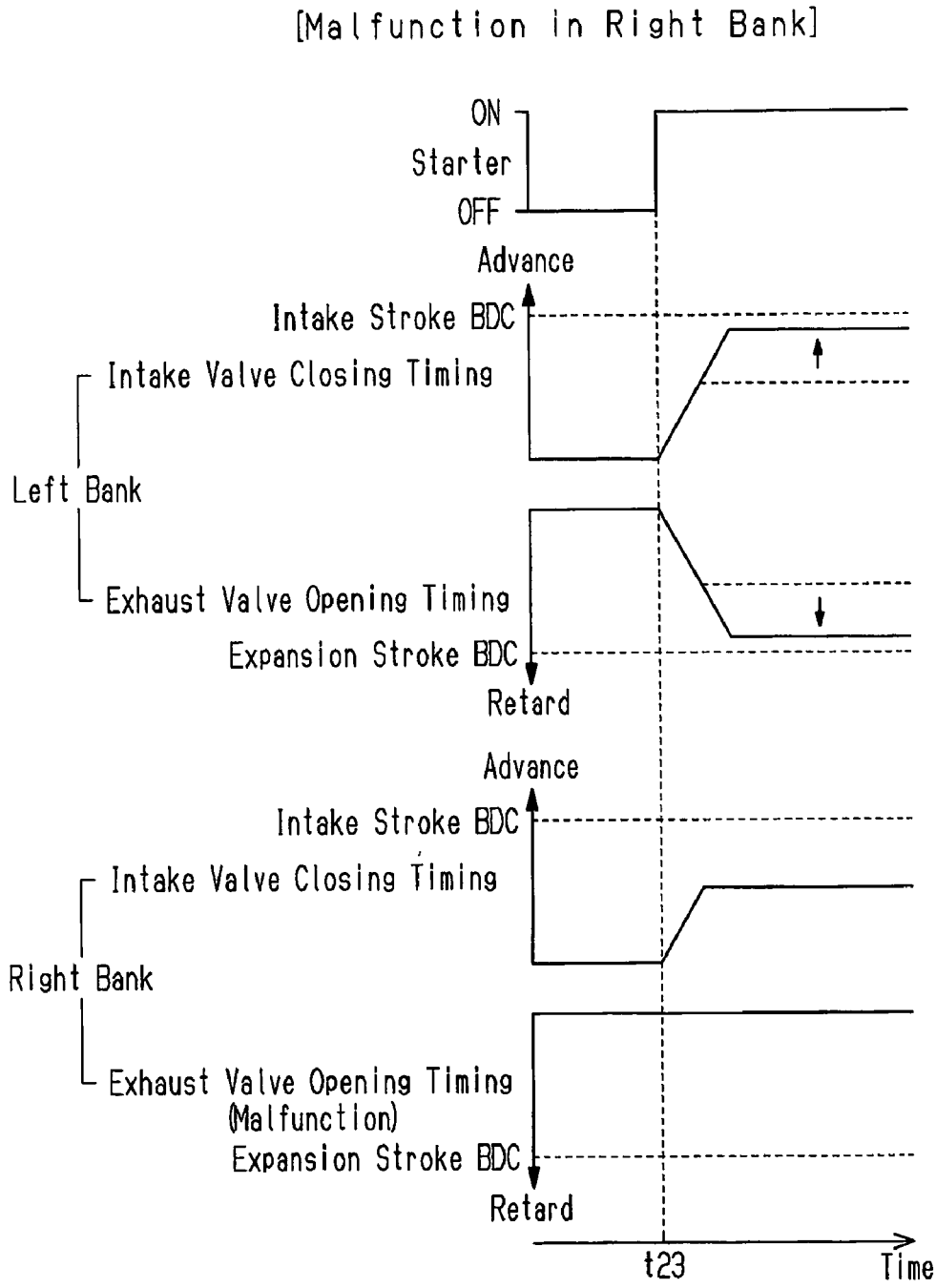
FIG. 13 is a timing chart showing another example of a control in abnormal condition according to the third embodiment.

Examples of the control executed according to the above described procedure will now be described with reference to FIGS. 12 and 13. FIG. 9 shows a timing chart of a case where the intake valve VVT in the right bank 8 is malfunctioning, FIG. 10 shows a timing chart of a case where the exhaust valve VVT in the right bank 8 is malfunctioning. The timing chart in the normal condition is the same as that according to the first embodiment shown in FIG. 5. In FIGS. 12 and 13, the intake valve closing timing of the normally functioning left bank 6 is caused to approach the intake stroke BDC immediately after the starter switch 42 is turned on (t22, t23) so that the exhaust valve opening timing approaches the expansion stroke BDC. This prevents the starting performance from deteriorating.

Steps S308 to S314 of the engine starting valve timing control process (FIG. 11) correspond to a process executed by the compensation section.

The third embodiment has the following advantages.

(1) Since the third embodiment has the same advantages as those of the first embodiment and the second embodiment, the starting performance of the engine 2 is more effectively prevented from deteriorating.

Figure 14:
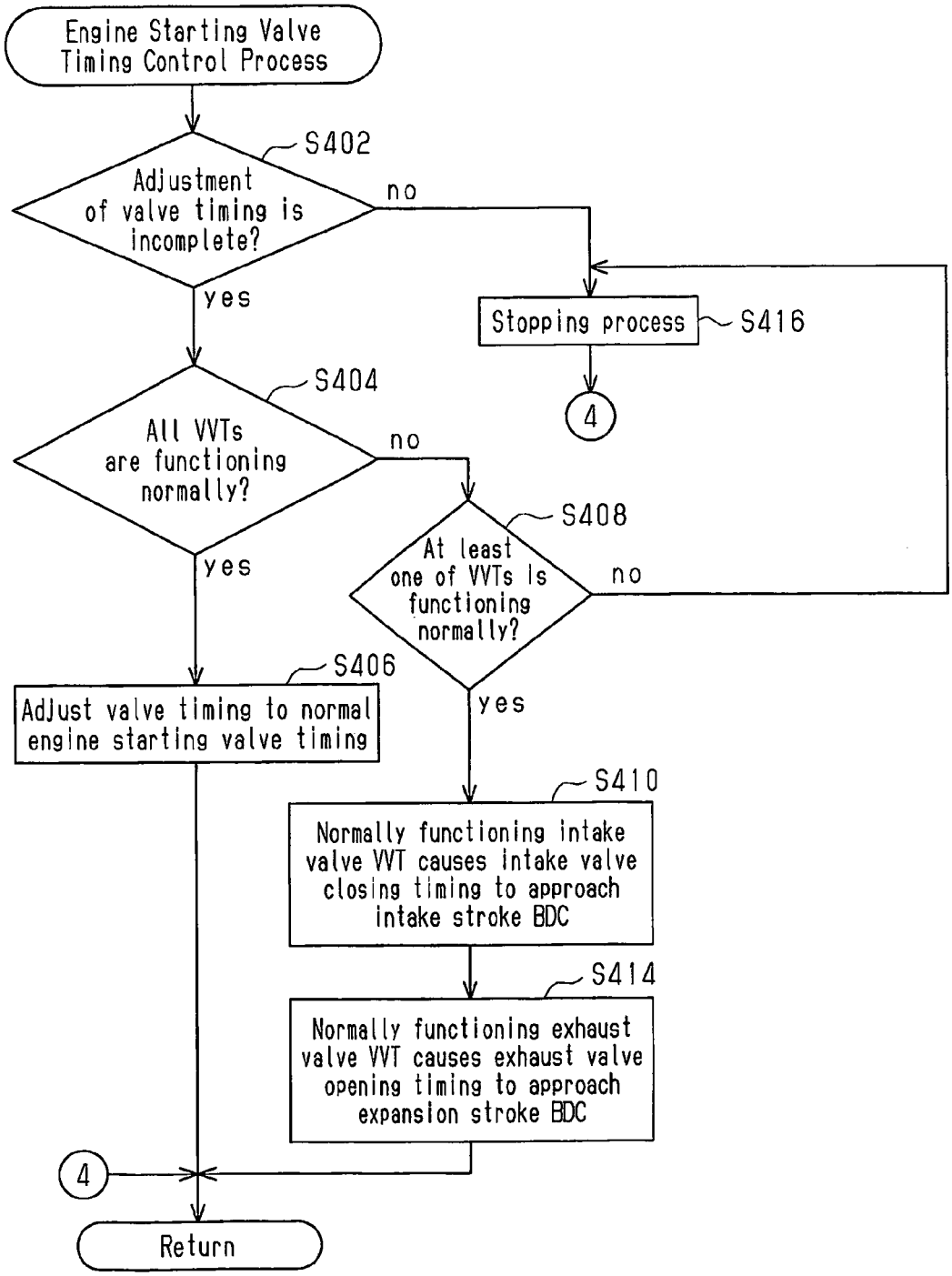
FIG. 14 is a flowchart showing an engine starting valve timing control process according to a fourth embodiment.

The fourth embodiment is different from the first embodiment in that an engine starting valve timing control process shown in FIG. 14 is executed instead of that shown in FIG. 3. The other components are the same as those in the first embodiment, and are thus described with reference to FIGS. 1 and 2.

The ECU 22 determines whether adjustment of the valve timing of the VVTs 10*d* to 16*d* required to be completed during starting incomplete (S402). Since the adjustment is incomplete at the beginning (yes at S402), whether the VVTs 10*d* to 16*d* in the left and right banks 6, 8 are all functioning normally is determined (S404). At the beginning, abnormality is not detected. Thus, the VVTs 10*d* to 16*d* are all determined to be functioning normally (yes at S404). Then, the VVTs 10*d* to 16*d* are controlled to adjust the valve timings to normal engine starting valve timings (S406). The process of step S406 is the same as that of step S106 of FIG. 3, and the intake valve timing and the exhaust valve timing are adjusted as shown by solid lines in FIGS. 4A and 4B. The current process is then temporarily ended.

If this process has been started again and is incomplete (yes at S402), whether the VVTs 10*d* to 16*d* in the left and right banks 6, 8 are all functioning normally is determined (S404). If the drive voltages and the drive currents are not different from those of the normal condition in any of the electric motors 68, 78, the VVTs 10*d* to 16*d* in the left and right banks 6, 8 are determined to be normal (yes at S404), and the above described normal engine starting VVT control (S406) is continued.

When the valve timing shown in FIG. 4 is achieved, the adjustment is determined to be complete (no at S402). In this case, a process for ending periodic execution of this process is executed (S416) for ending the process. In this manner, the engine starting valve timing control process is ended, and control after cranking is started.

If all the VVTs 10*d* to 16*d* are functioning normally, the same process as the process for normal condition shown in FIG. 3 is executed.

During the periodic execution of the engine starting valve-timing control process, if the drive voltage or the drive current of any of the four electric motors 68, 78 are different from the drive voltage and the drive current of the normal condition, it is determined that not all the VVTs 10*d* to 16*d* are functioning normally (no at S104).

Then, whether at least one of the VVTs 10*d* to 16*d* is functioning normally is determined (S408). If all the VVTs 10*d* to 16*d* are malfunctioning (no at S408), the process of step S416 is executed, and the current process is ended.

If at least one of the VVTs 10*d* to 16*d* is functioning normally (yes at S408), and the normally functioning one of the VVTs 10*d* to 16*d* is for an intake valve, a process for causing the intake valve closing timing to approach the intake stroke BDC (S410) is executed. If the normally functioning one of the VVTs 10*d* to 16*d* is for the exhaust valves, a process for causing exhaust valve opening timing to approach the expansion stroke BDC (S414) is executed.

Figure 15:
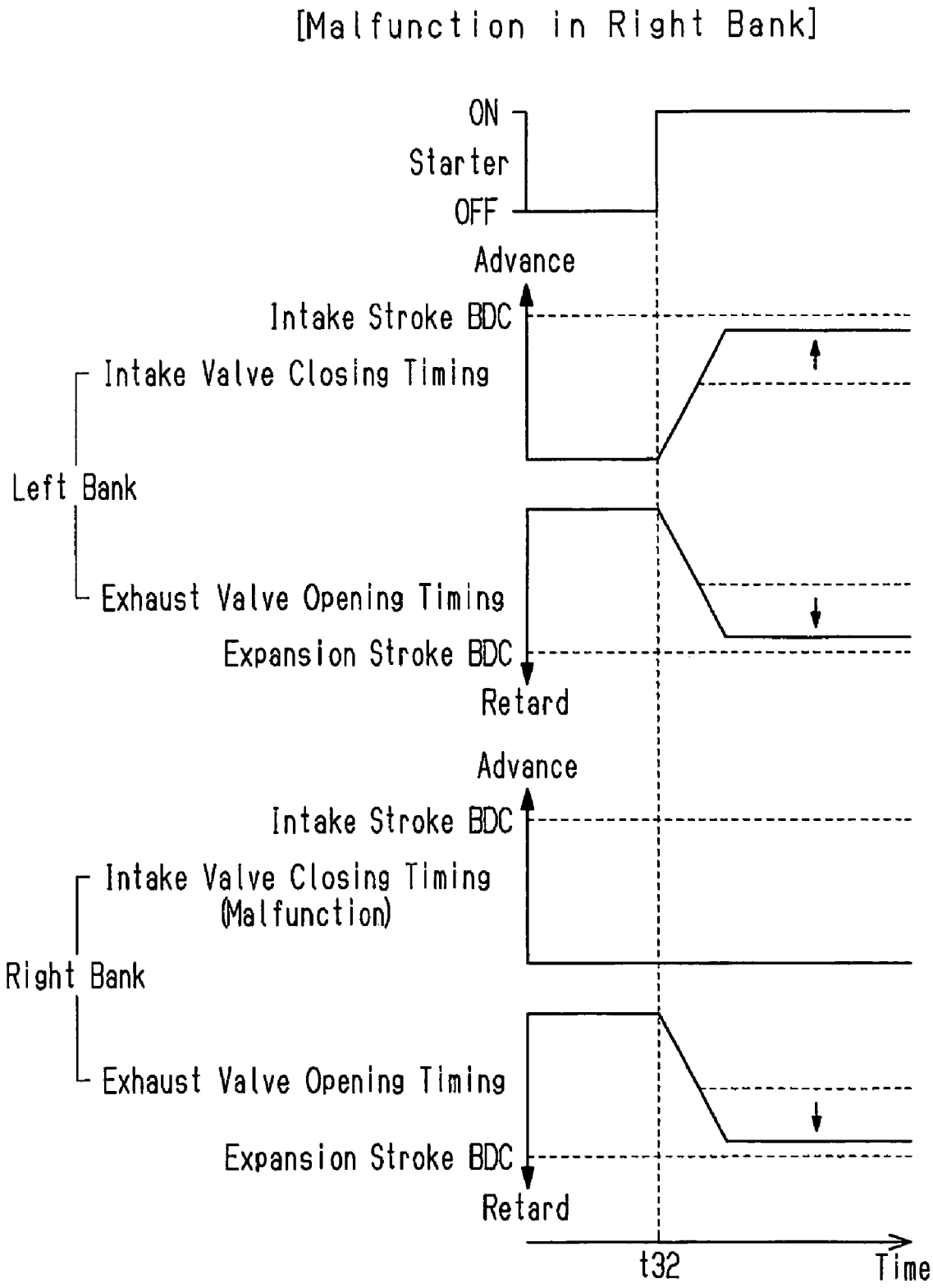
FIG. 15 is a timing chart showing an example of a control in abnormal condition according to the fourth embodiment.

For example, the timing chart of FIG. 15 shows a case in which the VVT 10*d* for the intake valve 10 and the VVT 14*d* for the exhaust valve 14 in the left bank 6 and the VVT 16*d* for the exhaust valve 16 in the right bank 8 are functioning normally, and the VVT 12*d* for the intake valve 12 in the right bank 8 is malfunctioning. In this case, the process for causing the intake valve closing timing of the left bank 6 to approach the intake stroke BDC is executed (S410), and the process for causing the exhaust valve opening timings of the left and right banks 6, 8 to approach the expansion stroke BDC (S414) is executed.

Figure 16:
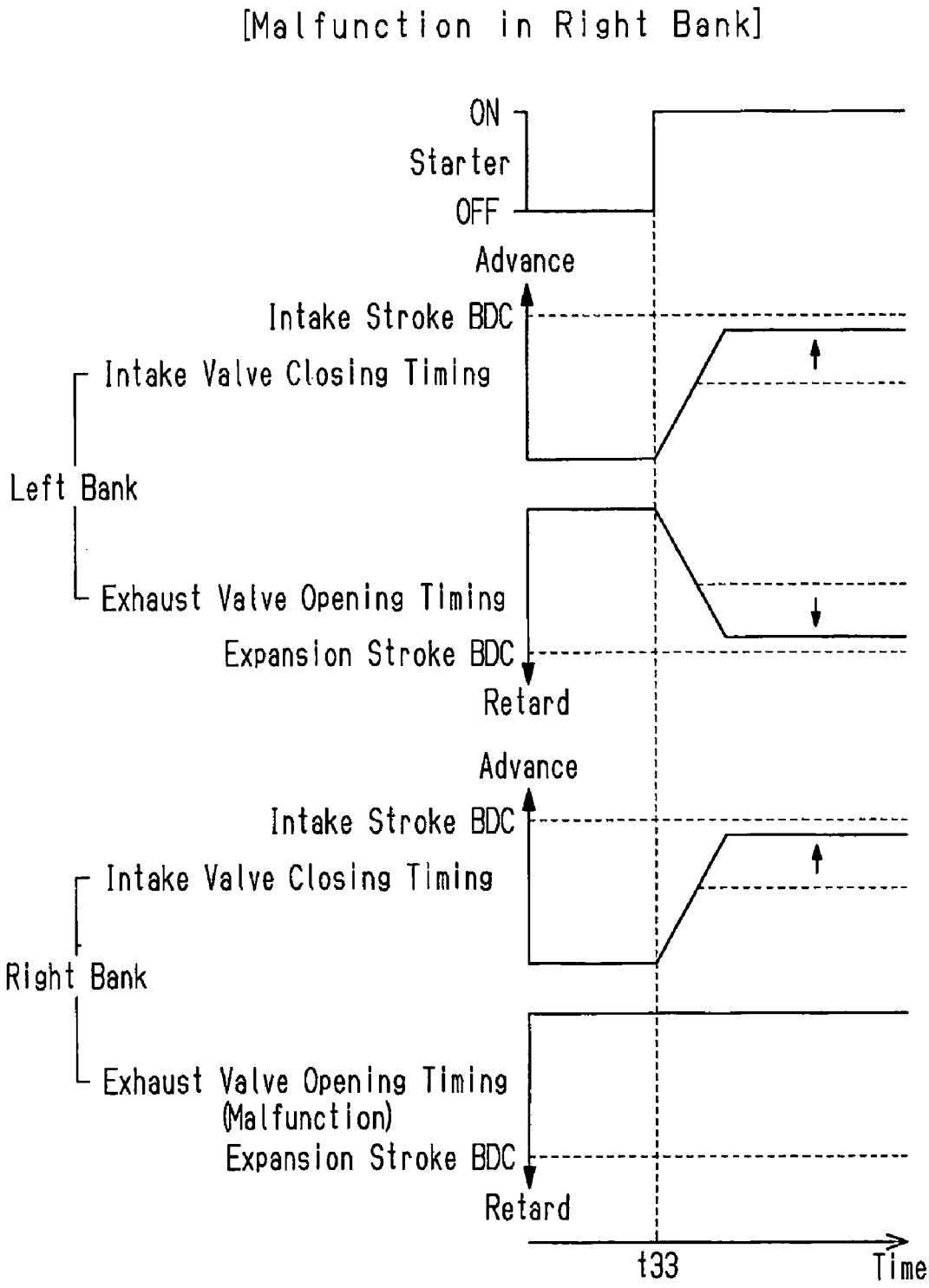
FIG. 16 is a timing chart showing another example of a control in abnormal condition according to the fourth embodiment.

FIG. 16 shows a case in which the VVT 10*d* for the intake valve 10 and the VVT 14*d* for the exhaust valve 14 in the left bank 6 and the VVT 12*d* for the intake valve 12 in the right bank 8 function normally, and the VVT 16*d* for the exhaust valve 16 in the right bank 8 is malfunctioning. In this case, the process for causing the intake valve closing timings of the left and right banks 6, 8 to approach the intake stroke BDC is executed (S410), and the process for causing the exhaust valve opening timing of the left bank 6 to approach the expansion stroke BDC (S414) is executed.

Figure 17:
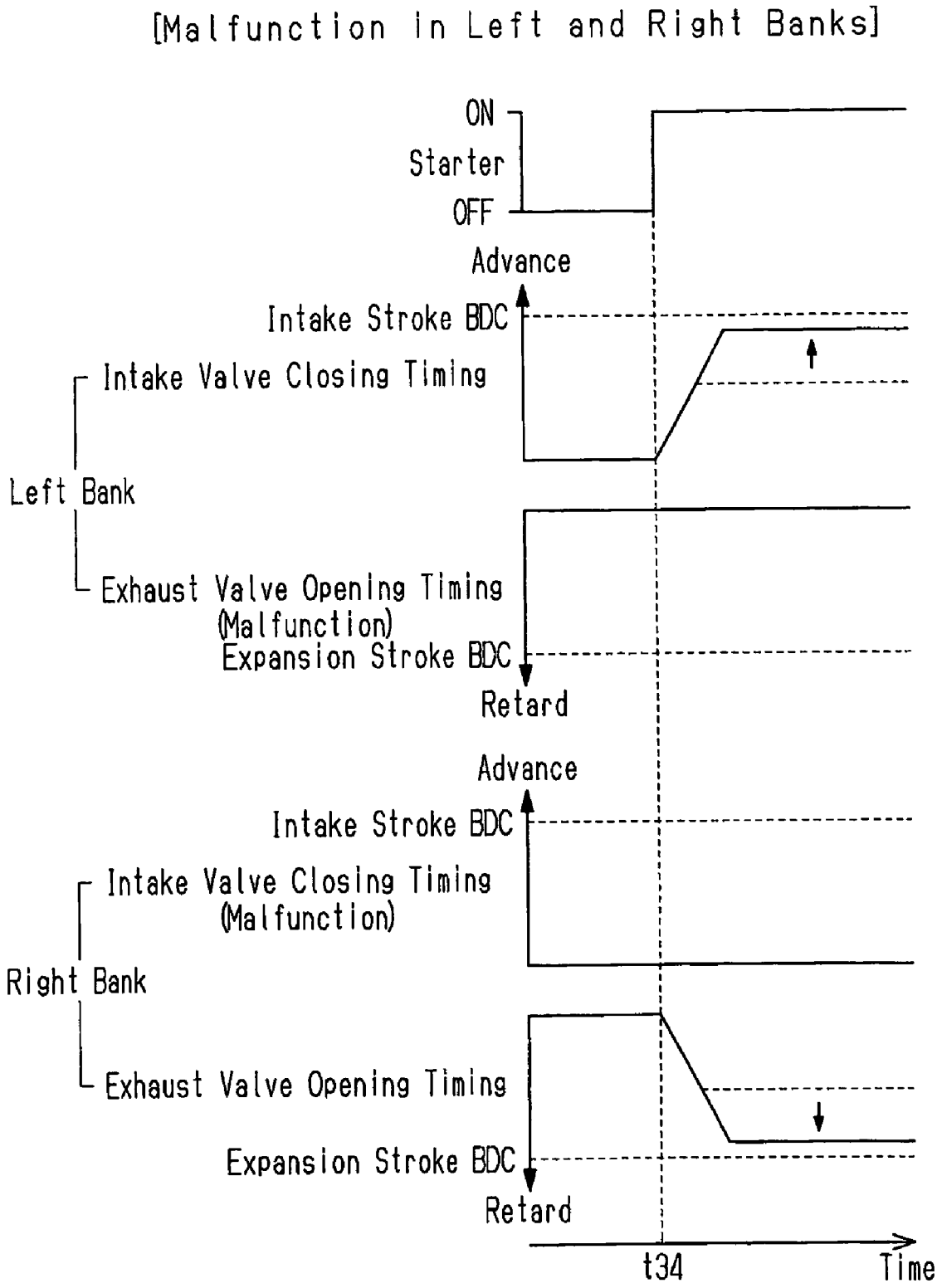
FIG. 17 is a timing chart showing another example of a control in abnormal condition according to the fourth embodiment.

FIG. 17 shows a case in which the VVT 10*d* for the intake valve 10 in the left bank 6 and the VVT 16*d* for the exhaust valve 16 in the right bank 8 are functioning normally, and the VVT 14*d* for the exhaust valve 14 in the left bank 6 and the VVT 12*d* for the intake valve 12 in the right bank 8 is malfunctioning. In this case, the process for causing the intake valve closing timing of the left bank 6 to approach the intake stroke BDC is executed (S410), and the process for causing the exhaust valve opening timing of the right bank 8 to approach the expansion stroke BDC (S414) is executed.

Figure 18:
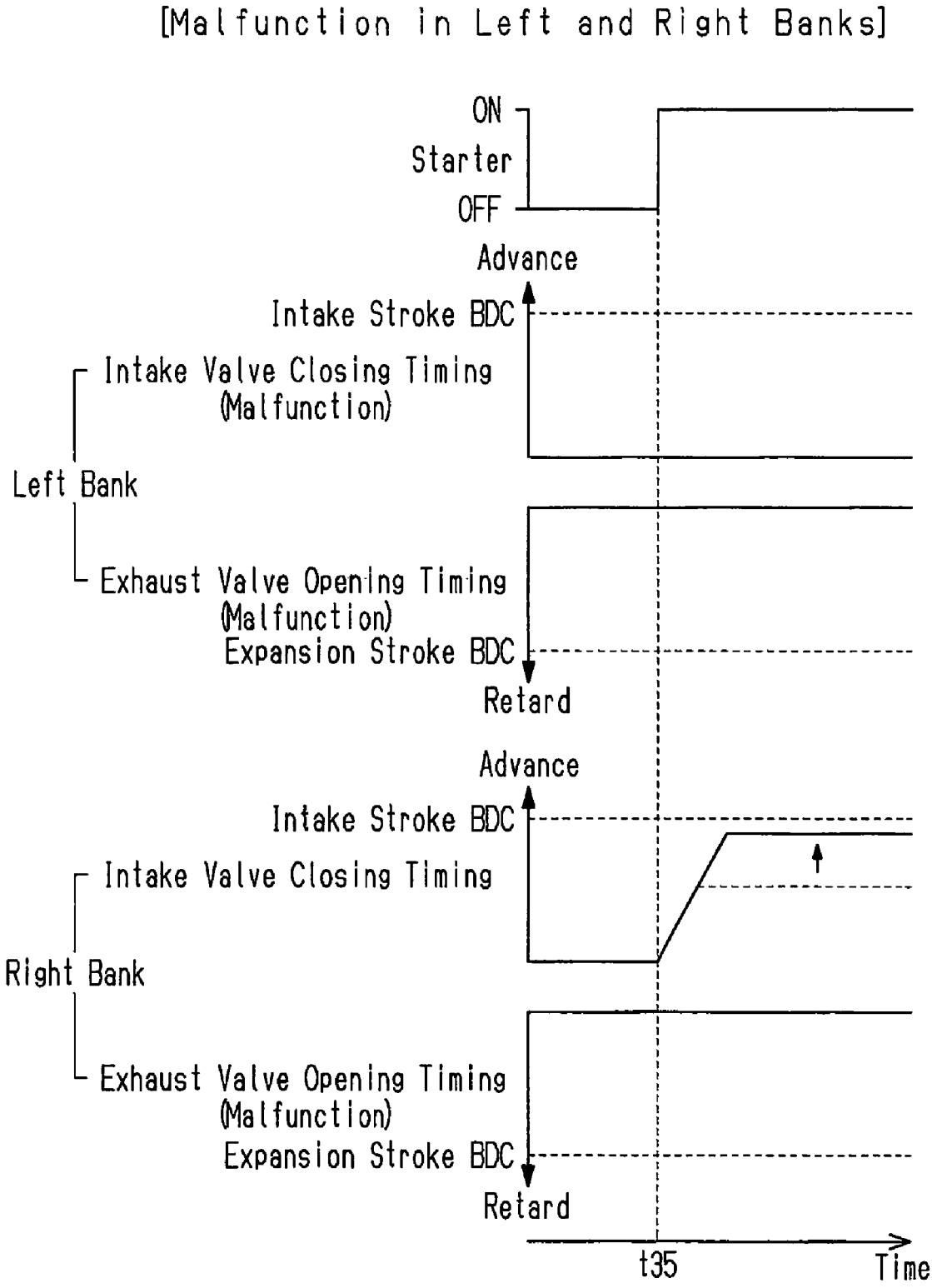
FIG. 18 is a timing chart showing another example of a control in abnormal condition according to the fourth embodiment.

FIG. 18 shows a case where only the VVT 12*d* for the intake valve 12 in the right bank 8 is functioning normally, and the other VVTs 10*d*, 14*d*, 16*d* are malfunctioning. In this case, the process for causing the intake valve closing timing of the right bank 8 to approach the intake stroke BDC is executed (S410), but the process of step S414 is not executed.

In this manner, when any one of the VVTs 10*d* to 16*d* is malfunctioning, the process for preventing deterioration of the starting performance is executed in all of the normally functioning ones of the VVTs 10*d* to 16*d*. A timing chart of the case where all the VVTs 10*d* 16*d* are functioning normally is the same as FIG. 5 according to the first embodiment.

Steps S408 to S414 of the engine starting valve timing control process (FIG. 14) correspond to a process executed by the compensation section.

The fourth embodiment described above has the following advantages.

(1) The fourth embodiment not only has the same advantages as those of the third embodiment, but also has an advantage in that, when one of the VVTs in one of the banks 6, 8 is malfunctioning, if the other VVT in the same bank is functioning normally, the normally functioning VVT is actuated to prevent deterioration of the starting performance. Therefore, deterioration of the starting performance is prevented more advantageously.

Figure 19:
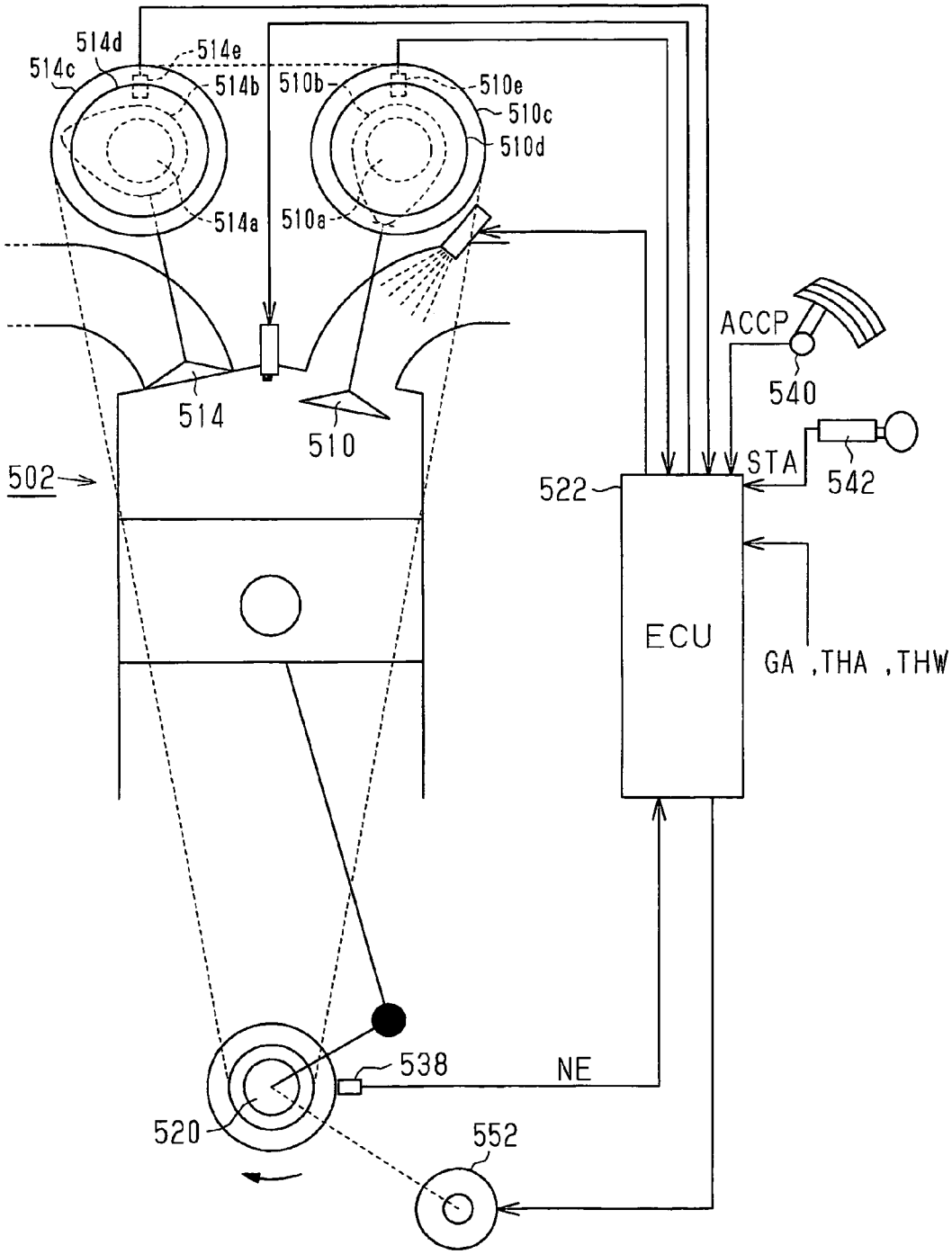
FIG. 19 is a diagrammatic view showing an engine and its control system according to a fifth embodiment.

The fifth embodiment relates to an engine 502 having a single bank as shown in FIG. 19. In the engine 502, a common intake camshaft 510*a* and a common exhaust camshaft 514*a* are provided for all the cylinders. The intake camshaft 510*a* has an intake valve VVT 510*d* that has the same structure as that of the intake valve VVT 10*d* of the first embodiment shown in FIG. 2. Therefore, the valve timings of the intake valves 510 of all the cylinders are uniformly adjusted by the intake valve VVT 510*d*.

Likewise, the exhaust camshaft 514*a* has an exhaust valve VVT 514*d* that has the same structure as that of the exhaust valve VVT 14*d* shown in FIG. 2. Therefore, the valve timings of the exhaust valves 514 of all the cylinders are uniformly adjusted by the exhaust valve VVT 514*d*.

Figure 20:
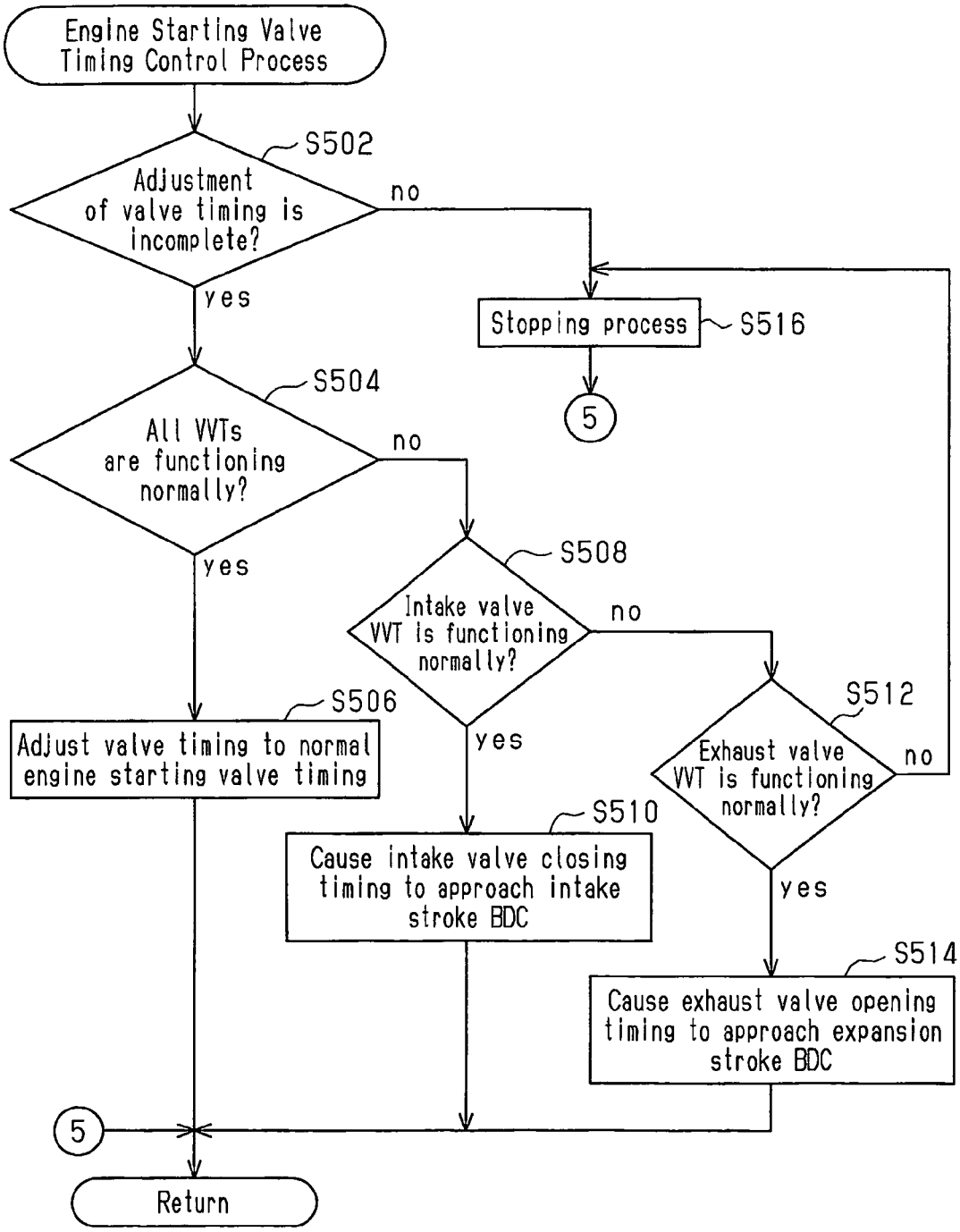
FIG. 20 is a flowchart showing an engine starting valve timing control process according to the fifth embodiment.

In the engine 502 thus configured, an ECU 522 executes an engine starting valve timing control process shown in a flowchart of FIG. 20. In this process, step S502 to S506, and S516 are the same as steps S402 to S406, and S416 of the fourth embodiment shown in FIG. 14.

A difference from the FIG. 14 is a process executed when one of the intake valve VVT 510*d* and the exhaust valve VVT 514*d* is malfunctioning. When the intake valve VVT 510*d* is functioning normally, and the exhaust valve VVT 514*d* is malfunctioning (yes at S508), a process is executed in which the intake valve VVT 510*d* causes the intake valve closing timing to approach the intake stroke BDC (S510). When the intake valve VVT 510*d* is malfunctioning, and the exhaust valve VVT 514*d* is functioning normally (yes at S512), a process is executed in which the exhaust valve VVT 514*d* causes the exhaust valve opening timing to approach the expansion stroke BDC (S514).

Figure 21:
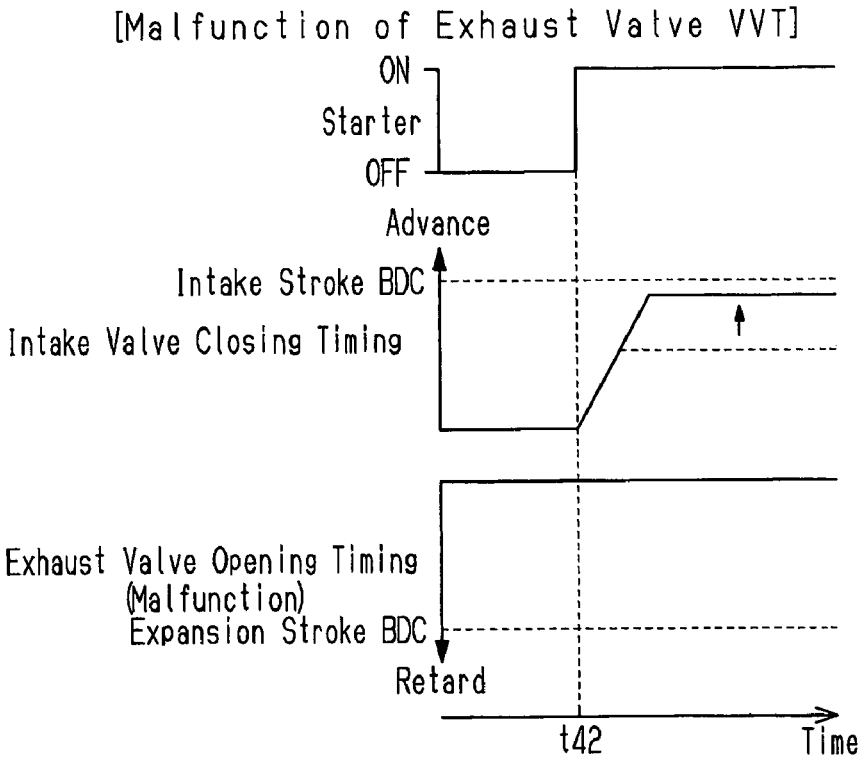
FIG. 21 is a timing chart showing an example of a control in abnormal condition according to the fifth embodiment.
Figure 22:
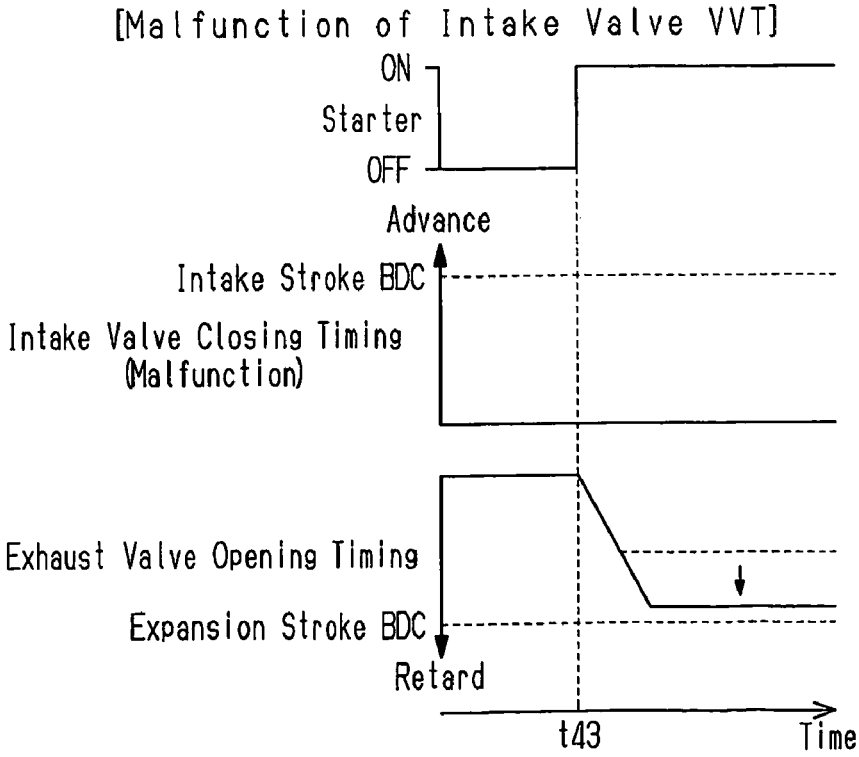
FIG. 22 is a timing chart showing another example of a control in abnormal condition according to the fifth embodiment.

The timing chart of FIG. 21 shows a case in which, during starting of the engine 502, the intake valve VVT 510*d* is functioning normally, and the exhaust valve VVT 514*d* is malfunctioning. The timing chart of FIG. 22 shows a case in which, during starting of the engine 502, the intake valve VVT 510*d* is malfunctioning, and the exhaust valve VVT 514*d* is functioning normally.

In the above described configuration, the ECU 522 corresponds to the abnormality detection section and the compensation section. An abnormality determination process for the VVTs 510*d* to 514*d* executed based on the drive voltages and the drive currents applied to the electric motors corresponds to a process executed by the abnormality detection section, and steps S508 to S514 of the engine starting valve timing control process (FIG. 20) correspond to a process executed by the compensation section.

The fifth embodiment described above has the following advantages.

(1) Even in the engine 502 having the intake valve VVT 510*d* and the exhaust valve VVT 514*d*, which are common to all the cylinders, when one of the VVTs 510*d*, 514*d* is malfunctioning, the other one of the VVTs 510*d*, 514*d* can be used to prevent deterioration of the starting performance. The fifth embodiment therefore has the same advantages as those of the first embodiment.

Embodiments other than the above illustrated embodiments will now be described.

(a) In the illustrated embodiments, the intake valve closing timing or the exhaust valve opening timing is caused to approach a BDC by a normally functioning VVT. The degree of approaching may be set such that the valve timing accurately matches with the BDC or such that the valve timing stays within a certain range including the BDC.

(b) In the illustrated embodiments, a reference which the intake valve closing timing or the exhaust valve opening timing is caused to approach is a BDC. However, an engine starting power compensation range may be set about each BDC, and the valve timings may be controlled to approach these ranges. To prevent the starting performance from deteriorating, the intake valve closing timing or the exhaust valve opening timing is controlled to be in the engine starting power compensation range.

(c) The structure of a VVT shown in FIG. 2 is merely one example. The present invention may be applied to any VVT as long as it changes a valve timing by using an electric motor, an electric actuator other than electric motors, or another drive source.

For example, the present invention may be applied to a VVT that has a phase advancing hydraulic pressure chamber and a phase retarding hydraulic pressure chamber arranged about a camshaft, and adjusts valve timings using hydraulic pressure. To apply the present invention to such a VVT, hydraulic pressure is accumulated, or hydraulic pressure is generated by an electric actuator prior to starting of the engine.

(d) In the illustrated first to fourth embodiments, the V angle of the engine 2 is 60 degrees. However, the V angle may be 40 degrees or 90 degrees. Further, the present invention may be applied to a horizontally-opposed engine.

(e) In the first to fourth embodiments, the VVTs are provided for both of the intake valves and the exhaust valves. However, it may be configured that only the intake valves or the exhaust valves of the left and right banks are provided with VVTs. In other words, two or more VVTs that can be independently controlled may be provided for two or more sets of a single type of valves, namely a set of intake valves or a set of exhaust valves. In this case, deterioration of the starting performance caused by malfunctioning one of the VVTs can be prevented by controlling the normally functioning VVT in the manner described in any of the illustrated embodiments.

The present invention may also be applied to an engine with one bank as in the fifth embodiment, in which, however, the cylinders are divided into two or more cylinder groups, and two or more VVTs are provided for two or more sets of a single type of valves, namely a set of intake valves or a set of exhaust valves. In this case, deterioration of the starting performance caused by malfunctioning one of the VVTs can be prevented by controlling the normally functioning VVT in the manner described in any of the illustrated embodiments.

(f) In the illustrated embodiments, the intake valve closing timing and the exhaust valve opening timing are adjusted by advancing or retarding the entire period during which the valve is open. However, as for the intake valve, only the valve closing timing may be adjusted without changing the valve opening timing. As for the exhaust valve, only the valve opening timing may be adjusted without changing the valve closing timing. Such adjustment is possible by adding a mechanism for adjusting the valve lift to the VVTs according to the illustrated embodiments.

The invention claimed is:

1. An apparatus for adjusting valve timing when starting an internal combustion engine, the engine having a plurality of variable valve timing mechanisms, wherein the valve timing mechanisms include a first variable valve timing mechanism that is capable of adjusting the valve timing of an intake valve and a second variable valve timing mechanism that is capable of adjusting the valve timing of an exhaust valve, the apparatus comprising:

an abnormality detection section that detects an abnormality in the valve timing mechanisms; and a compensation section, wherein, when the abnormality detection section detects an abnormality of at least one of the valve timing mechanisms, the compensation section adjusts the valve timing during starting of the engine realized by at least one of the valve timing mechanisms that is functioning normally to valve timing that increases the power generated by combustion compared to the power generated during normal starting of the engine, wherein, if the first variable valve timing mechanism is functioning normally when the abnormality detection section detects an abnormality of the second variable valve timing mechanism, the compensation section controls the first variable valve timing mechanism such that the valve closing timing of the intake valve becomes closer to a bottom dead center in the intake stroke of the engine or a power compensation range set in the vicinity of the bottom dead center compared to the valve closing timing of the intake valve during normal starting of the engine, wherein, if the second variable valve timing mechanism is functioning normally when the abnormality detection section detects an abnormality of the first variable valve timing mechanism, the compensation section controls the second variable valve timing mechanism such that the valve opening timing of the exhaust valve becomes closer to a bottom dead center in the expansion stroke of the engine or a power compensation range set in the vicinity of the bottom dead center compared to the valve opening timing of the exhaust valve during normal starting of the engine.

2. The apparatus according to claim 1, wherein the engine includes a plurality of groups of cylinders, each variable valve timing mechanism corresponding to one of the cylinder groups, wherein, when the abnormality detection section detects an abnormality, the compensation section adjusts the valve timing during starting of the engine of the cylinder group that corresponds to the normally functioning variable valve timing mechanism.

3. The apparatus according to claim 2, wherein the engine includes a plurality of banks each having one of the cylinder groups, each variable valve timing mechanism corresponding to one of the banks.

4. The apparatus according to claim 1, wherein each variable valve timing mechanism is driven by an electric actuator.

5. An apparatus for adjusting valve timing when starting an internal combustion engine, the engine including a plurality of groups of cylinders and a plurality of variable valve timing mechanisms each corresponding to one of the cylinder groups, wherein each valve timing mechanism is capable of adjusting the valve timing of an intake valve or an exhaust valve, the apparatus comprising:

an abnormality detection section that detects an abnormality in the valve timing mechanisms; and a compensation section, wherein, when the abnormality detection section detects an abnormality of at least one of the valve timing mechanisms, the compensation section adjusts the valve timing during starting of the engine realized by at least one of the valve timing mechanisms that is functioning normally to valve timing that increases the power generated by combustion compared to the power generated during normal starting of the engine, wherein, when the abnormality detection section detects an abnormality, the compensation section adjusts the valve timing during starting of the engine of the cylinder group that corresponds to the normally functioning variable valve timing mechanism.

6. The apparatus according to claim 5, wherein the engine includes a plurality of banks each having one of the cylinder groups, each variable valve timing mechanism corresponding to one of the banks.

7. The apparatus according to claim 5, wherein the variable valve timing mechanisms include a first variable valve timing mechanism and a second variable valve timing mechanism, the first variable valve timing mechanism being capable of adjusting at least one of the valve closing timing of the intake valves and the valve opening timing of the exhaust valves, and the second variable valve timing mechanism being capable of adjusting the valve closing timing of the intake valves, wherein the cylinder groups include a first cylinder group and a second cylinder group, the first cylinder group having the first variable valve timing mechanism, and the second cylinder group having the second variable valve timing mechanism, wherein, when the abnormality detection section detects an abnormality only in the first variable valve timing mechanism, the compensation section causes the second variable valve timing mechanism to adjust the valve closing timing of the intake valves during starting of the engine.

8. The apparatus according to claim 5, wherein the variable valve timing mechanisms include a first variable valve timing mechanism and a second variable valve timing mechanism, the first variable valve timing mechanism being capable of adjusting at least one of the valve closing timing of the intake valves and the valve opening timing of the exhaust valves, and the second variable valve timing mechanism being capable of adjusting the valve opening timing of the exhaust valves, wherein the cylinder groups include a first cylinder group and a second cylinder group, the first cylinder group having the first variable valve timing mechanism, and the second cylinder group having the second variable valve timing mechanism, wherein, when the abnormality detection section detects an abnormality only in the first variable valve timing mechanism, the compensation section causes the second variable valve timing mechanism to adjust the valve opening timing of the exhaust valves during starting of the engine.

9. The apparatus according to claim 5, wherein each variable valve timing mechanism is driven by an electric actuator.

* * * * *